US006490730B1

(12) United States Patent
Lyden

(10) Patent No.: US 6,490,730 B1
(45) Date of Patent: Dec. 10, 2002

(54) SHIN-GUARD, HELMET, AND ARTICLES OF PROTECTIVE EQUIPMENT INCLUDING LIGHT CURE MATERIAL

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 0 days.

(21) Appl. No.: 09/523,851

(22) Filed: Mar. 13, 2000

Related U.S. Application Data

(63) Continuation-in-part of application No. 08/862,598, filed on May 23, 1997, which is a continuation of application No. 08/510,433, filed on Aug. 2, 1995, now Pat. No. 5,632,057, which is a continuation of application No. 08/275,642, filed on Jul. 14, 1994, now abandoned, which is a continuation of application No. 08/074,771, filed on Jun. 9, 1993, now abandoned, which is a continuation-in-part of application No. 07/976,407, filed on Nov. 13, 1992, now abandoned, which is a division of application No. 07/805,596, filed on Dec. 11, 1991, now Pat. No. 5,203,793, which is a continuation-in-part of application No. 07/714,971, filed on Jun. 13, 1991, now Pat. No. 5,101,580, which is a continuation of application No. 07/410,074, filed on Sep. 20, 1989, now abandoned.

(51) Int. Cl.[7] ..... A41D 13/00
(52) U.S. Cl. ..... 2/22; 602/2
(58) Field of Search ..... 2/22, 24, 455, 2/69, 463–467, 2.5, 267, 410–415, 425, 911, 918, DIG. 3; 128/882, DIG. 20; 12/146 M; 36/93; 602/5–8, 20, 23, 41, 60, 62

(56) References Cited

U.S. PATENT DOCUMENTS

| | | | | |
|---|---|---|---|---|
| 2,982,968 | A | 5/1961 | Groot | 2/22 |
| 3,613,675 | A | 10/1971 | Larsen | 128/90 |
| 3,866,243 | A | 2/1975 | Morgan | 2/3 R |
| 3,874,376 | A | 4/1975 | Dart et al. | 128/90 |
| 3,905,376 | A | 9/1975 | Johnson et al. | 128/595 |
| 4,071,424 | A | 1/1978 | Dart et al. | 204/159.19 |
| 4,183,156 | A | 1/1980 | Rudy | 36/44 |
| 4,217,705 | A | 8/1980 | Donzis | 36/29 |
| 4,219,945 | A | 9/1980 | Rudy | 36/29 |

(List continued on next page.)

FOREIGN PATENT DOCUMENTS

| | | |
|---|---|---|
| DE | 3011566 A1 | 11/1980 |
| DE | 4403390 A1 | 4/1994 |
| GB | 1512553 | 6/1978 |

OTHER PUBLICATIONS

Frank H. Netter, M.D., *Atlas of Human Anatomy*, 189, Plate No. 491.

Abstract, *Neurology*, 1998, Sep.; 51 (3): 791–6, "Chronic Traumatic Brain Injury in Professional Soccer Players.".

Abstract, *Tidsskr Nor Laegeforen*, 1992, Apr. 10; 112 (10): 1268–71, "Head and Neck Injuries Among Norwegian Soccer Players. A Neurological, electroencephalographic, Radiologic and neuropsychological evaluation.".

*Primary Examiner*—Gloria M. Hale
*Assistant Examiner*—Tejash Patel
(74) *Attorney, Agent, or Firm*—Westman, Champlin & Kelly, P.A.

(57) ABSTRACT

The present invention teaches novel articles of apparel and protective equipment including light-cure materials having a permanent memory capability. Accordingly, the present invention can be used to make shin-guards, knee pads, thigh pads, hip pads, rib guards, shoulder pads, elbow pads, biceps pads, forearm pads, gloves, neck guards, face guards, chin straps, wrist guards, helmets and prosthetic devices.

28 Claims, 12 Drawing Sheets

U.S. PATENT DOCUMENTS

| | | | | | |
|---|---|---|---|---|---|
| 4,235,686 | A | | 11/1980 | Dart et al. | 204/159.19 |
| 4,271,606 | A | | 6/1981 | Rudy | 36/29 |
| 4,287,250 | A | | 9/1981 | Rudy | 428/166 |
| 4,287,613 | A | | 9/1981 | Schultz | 2/413 |
| 4,292,263 | A | | 9/1981 | Hanrahan et al. | 264/46.5 |
| 4,306,315 | A | | 12/1981 | Castiglia | |
| D264,140 | S | | 5/1982 | Jenkins | |
| 4,340,626 | A | | 7/1982 | Rudy | 428/35 |
| 4,344,189 | A | | 8/1982 | Futere et al. | |
| 4,370,754 | A | | 2/1983 | Donzis | 2/2 |
| D269,134 | S | | 5/1983 | Buring et al. | |
| D269,920 | S | | 8/1983 | Buring et al. | |
| 4,441,211 | A | | 4/1984 | Donzis | 2/2 |
| 4,453,271 | A | | 6/1984 | Donzis | 2/2 |
| 4,484,360 | A | | 11/1984 | Leighton et al. | |
| 4,486,901 | A | | 12/1984 | Donzis | 2/2 |
| D278,470 | S | | 4/1985 | Eghamn | |
| 4,512,340 | A | | 4/1985 | Buck | 128/90 |
| 4,513,449 | A | | 4/1985 | Donzis | 2/2 |
| D284,038 | S | | 6/1986 | Eghamn et al. | |
| 4,646,368 | A | | 3/1987 | Infusino et al. | 2/421 |
| 4,667,661 | A | | 5/1987 | Scholtz et al. | 128/90 |
| 4,669,126 | A | | 6/1987 | Jones | |
| 4,674,206 | A | | 6/1987 | Lyden | 36/88 |
| 4,683,877 | A | | 8/1987 | Ersfeld et al. | 128/90 |
| 4,756,026 | A | | 7/1988 | Pierce, Jr. | |
| 4,774,937 | A | | 10/1988 | Scholz et al. | 128/90 |
| 4,831,668 | A | | 5/1989 | Schultz | 2/414 |
| 4,856,502 | A | | 8/1989 | Ersfeld et al. | 128/90 |
| 4,872,216 | A | | 10/1989 | Wingo | 2/2 |
| 4,874,640 | A | | 10/1989 | Donzis | 427/421 |
| 4,888,225 | A | | 12/1989 | Sandrig et al. | 428/71 |
| 4,903,350 | A | | 2/1990 | Gentes et al. | 2/421 |
| 4,906,502 | A | | 3/1990 | Rudy | 428/69 |
| 4,926,501 | A | | 5/1990 | Goosen | |
| 4,926,503 | A | | 5/1990 | Wingo | 2/267 |
| 4,936,029 | A | | 6/1990 | Rudy | 36/29 |
| D310,278 | S | | 8/1990 | Quinlan | |
| 4,946,726 | A | | 8/1990 | Sandrig et al. | 428/76 |
| D311,977 | S | | 11/1990 | Eghamn | |
| 4,970,807 | A | | 11/1990 | Anderié et al. | 36/28 |
| 4,985,931 | A | | 1/1991 | Wingo | 2/2 |
| 4,993,082 | A | | 2/1991 | Gentes et al. | 2/410 |
| 4,999,847 | A | | 3/1991 | Barcelo | |
| 5,002,047 | A | | 3/1991 | Sandrig et al. | 128/90 |
| 5,014,689 | A | | 5/1991 | Meunchen et al. | 128/77 |
| 5,029,341 | A | | 7/1991 | Wingo | 2/2 |
| 5,035,009 | A | | 7/1991 | Wingo | 2/414 |
| 5,036,761 | A | | 8/1991 | Wingo | 101/148 |
| 5,040,795 | A | | 8/1991 | Sonntag | 273/58 |
| 5,042,176 | A | | 8/1991 | Rudy | 36/29 |
| 5,042,464 | A | | 8/1991 | Skwor et al. | 128/80 C |
| 5,083,361 | A | | 1/1992 | Rudy | 29/454 |
| 5,101,580 | A | | 4/1992 | Lyden | 36/93 |
| 5,118,722 | A | | 6/1992 | Wollmann et al. | 521/137 |
| 5,175,889 | A | | 1/1993 | Infusino | 2/413 |
| 5,181,717 | A | | 1/1993 | Donntag et al. | 273/58 BA |
| 5,190,802 | A | | 3/1993 | Pilato | 428/111 |
| 5,203,793 | A | | 4/1993 | Lyden | 36/88 |
| 5,235,715 | A | | 8/1993 | Donzis | 12/142 R |
| 5,263,203 | A | | 11/1993 | Kraemer et al. | 2/413 |
| 5,297,294 | A | | 3/1994 | Washick | |
| 5,301,370 | A | | 4/1994 | Henson | |
| 5,378,531 | A | * | 1/1995 | Larson et al. | 12/142 N |
| 5,381,560 | A | | 1/1995 | Halstead | 2/421 |
| 5,384,913 | A | | 1/1995 | Hendry | |
| 5,405,312 | A | | 4/1995 | Jacobs | |
| 5,406,719 | A | | 4/1995 | Potter | |
| 5,435,007 | A | | 7/1995 | Kalvestram et al. | 2/16 |
| 5,437,112 | A | | 8/1995 | Johnson | 36/128 |
| D362,087 | S | | 9/1995 | Anson | |
| 5,454,780 | A | | 10/1995 | Duback et al. | 602/8 |
| 5,456,658 | A | | 10/1995 | Duback et al. | |
| 5,477,559 | A | | 12/1995 | Clement | |
| 5,480,376 | A | | 1/1996 | Duback et al. | |
| 5,481,762 | A | | 1/1996 | Gentes et al. | 2/411 |
| 5,491,840 | A | | 2/1996 | Yen | |
| 5,543,194 | A | | 8/1996 | Rudy | 428/69 |
| 5,544,663 | A | | 8/1996 | Duback | 128/846 |
| 5,572,804 | A | | 11/1996 | Skaja et al. | |
| 5,575,017 | A | | 11/1996 | Hefling et al. | 2/418 |
| 5,581,817 | A | | 12/1996 | Hicks | |
| 5,592,706 | A | | 1/1997 | Pearce | |
| D378,624 | S | | 3/1997 | Chartrand | D29/106 |
| 5,611,080 | A | | 3/1997 | Skottheim | |
| 5,625,896 | A | * | 5/1997 | LaBarbera et al. | 2/22 |
| 5,626,657 | A | | 5/1997 | Pearce | |
| 5,632,057 | A | * | 5/1997 | Lyden | 12/146 B |
| 5,637,077 | A | | 6/1997 | Parker | |
| D381,131 | S | | 7/1997 | Duback et al. | |
| 5,659,900 | A | | 8/1997 | Arney et al. | 2/417 |
| D389,959 | S | | 1/1998 | Collins et al. | |
| 5,711,028 | A | | 1/1998 | Bourque et al. | |
| 5,732,411 | A | | 3/1998 | Coleman et al. | |
| 5,732,713 | A | | 3/1998 | Duback et al. | 128/846 |
| 5,742,938 | A | | 4/1998 | Winningham et al. | 2/22 |
| 5,742,945 | A | | 4/1998 | Lindaman | |
| D394,110 | S | | 5/1998 | Duback et al. | |
| D394,112 | S | | 5/1998 | Duback et al. | |
| 5,755,001 | A | | 5/1998 | Potter et al. | |
| 5,755,678 | A | | 5/1998 | Parker et al. | |
| D394,905 | S | | 6/1998 | Duback et al. | |
| D395,158 | S | | 6/1998 | Lindaman | |
| 5,766,141 | A | | 6/1998 | Gould | 602/21 |
| 5,769,804 | A | | 6/1998 | Harris et al. | 602/21 |
| 5,778,449 | A | | 7/1998 | Oetting et al. | 2/16 |
| 5,794,272 | A | | 8/1998 | Workman et al. | 2/421 |
| 5,794,274 | A | | 8/1998 | Kraemer | 2/421 |
| 5,802,739 | A | | 9/1998 | Potter et al. | |
| 5,813,050 | A | | 9/1998 | Popowski | 2/16 |
| 5,829,055 | A | | 11/1998 | Collins et al. | |
| 5,832,630 | A | | 11/1998 | Potter | |
| 5,842,475 | A | | 12/1998 | Duback et al. | |
| 5,868,693 | A | | 2/1999 | Duback et al. | |
| 5,890,224 | A | | 4/1999 | Clark | |
| 5,911,310 | A | * | 6/1999 | Bridgers | 2/22 |
| 5,926,844 | A | | 7/1999 | Bear | |
| 5,952,078 | A | | 9/1999 | Park | |
| 5,976,451 | A | | 11/1999 | Skaja et al. | |
| 5,979,078 | A | | 11/1999 | McLaughlin | |
| 5,993,585 | A | | 11/1999 | Goodwin et al. | |
| 6,013,340 | A | | 1/2000 | Bonk et al. | |
| 6,020,055 | A | | 2/2000 | Pearce | |
| 6,029,962 | A | | 2/2000 | Shorten et al. | |
| 6,082,025 | A | | 7/2000 | Bonk et al. | |
| 6,098,313 | A | | 8/2000 | Skaja | |
| 6,105,164 | A | * | 8/2000 | Huang | 2/22 |
| 6,119,371 | A | | 9/2000 | Goodwin et al. | |
| 6,126,626 | A | | 10/2000 | Duback et al. | |
| 6,127,026 | A | | 10/2000 | Bonk et al. | |
| 6,128,777 | A | | 10/2000 | Foreman | |
| 6,131,195 | A | | 10/2000 | Foreman | |
| 6,134,720 | A | * | 10/2000 | Foreman | 2/455 |
| 6,152,892 | A | | 11/2000 | Masini | |
| 6,161,240 | A | | 12/2000 | Huang | |
| 6,178,556 | B1 | * | 1/2001 | Foreman et al. | 2/22 |
| 6,202,223 | B1 | | 3/2001 | Chartrand | |
| 6,205,583 | B1 | | 3/2001 | Beland | |
| 6,226,795 | B1 | | 5/2001 | Winningham | |
| 6,226,797 | B1 | | 5/2001 | Tollini | |
| 6,247,188 | B1 | | 6/2001 | Beland | |

D445,221 S 7/2001 Foreman et al.
6,258,421 B1 7/2001 Potter
6,269,485 B1 8/2001 Foreman
6,298,484 B1 10/2001 Beckman

* cited by examiner

FIG. 15
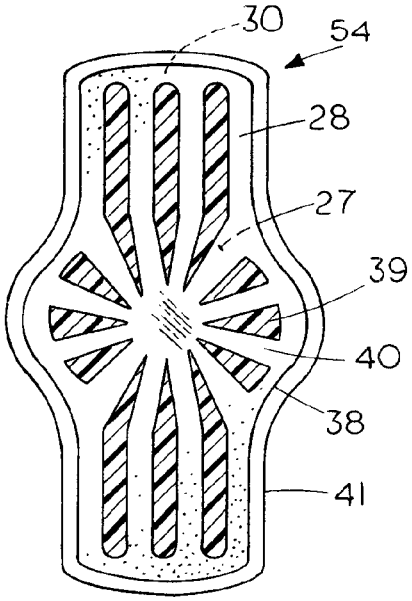
FIG. 16.1
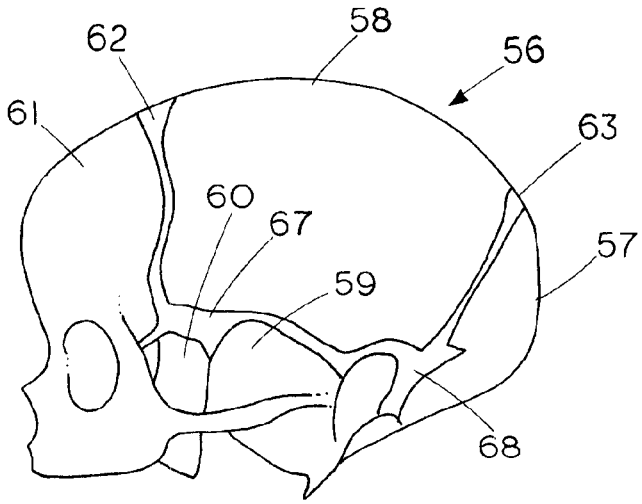
FIG. 16.2
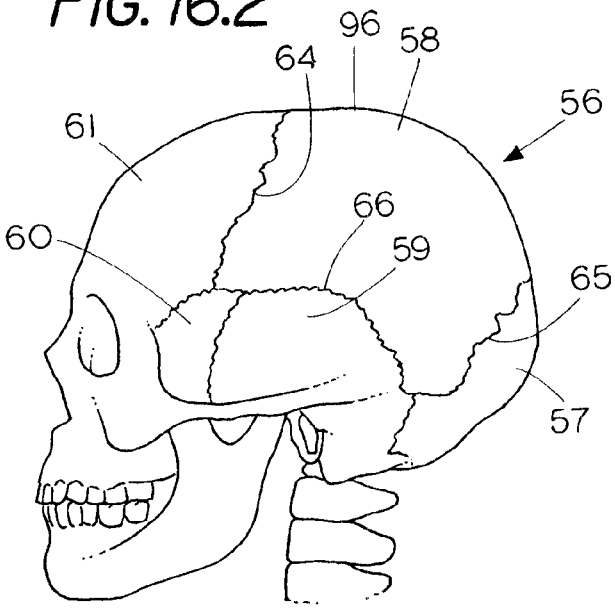

SHIN-GUARD, HELMET, AND ARTICLES OF PROTECTIVE EQUIPMENT INCLUDING LIGHT CURE MATERIAL

RELATED U.S. APPLICATION DATA

Continuation-In-Part of Ser. No. 08/862,598 filed on May 23, 1997, which was a Continuation of Ser. No. 08/510,433 filed on Aug. 2, 1995 which became U.S. Pat. No. 5,632,057, which was a Continuation of Ser. No. 08/275,642 filed on Jul. 14, 1994 Abandoned, which was a Continuation of Ser. No. 08/074,771 filed on Jun. 9, 1993 Abandoned, which was a Continuation-In-Part of Ser. No. 07/976,407, filed Nov. 13, 1992 Abandoned, which was a Divisional of Ser. No. 07/805,596 filed Dec. 11, 1991 which became U.S. Pat. No. 5,203,793, which was a Continuation-In-Part of Ser. No. 07/714,971 filed on Jun. 13, 1991 which became U.S. Pat. No. 5,101,580, which was a Continuation of Ser. No. 07/410,074 filed on Sep. 20, 1989, Abandoned. Cross reference is also made to U.S. Pat. No. 4,674,206.

FIELD OF THE INVENTION

The present invention relates to the field of apparel, and in particular, to shin-guards, pads, helmets, prosthetics, and other articles of protective equipment.

BACKGROUND OF THE INVENTION

The use of shin-guards, knee pads, thigh pads, hip pads, rib guards, shoulder pads, elbow pads, biceps pads, forearm pads, gloves, neck guards, face guards, chin straps and guards, wrist guards, braces, and helmets is prevalent in a large number of contact and non-contact sports including soccer, football, hockey, baseball, volleyball, and in-line skating. Protective knee pads and helmets also enjoy widespread use in the construction industry, military, and in the field of transportation including bicycle, motorcycle, and sports automobile operation. Prosthetic devices such as back supports and wrist guards. which include conforming shields or pads are also widely used.

Many articles of athletic and protective equipment include a hard outer shell made of leather, natural or synthetic rubber, glass or carbon fiber composites, thermoplastics, metal, and the like. Often, such articles will include a relatively soft inner liner of padding material which is made, e.g., of cotton, wool, natural or synthetic rubber, thermoplastic material, foam material, gas filled bladders, flowable solids or liquids, bladders including amoldable and curable material, or various textile materials. Most of these articles of protective equipment have relied upon the incorporation of generic norms or average shapes with regards to those surfaces contacting the anatomy in order to provide limited accommodation to the unique anatomical features and characteristics of an individual wearer. However, pre-formed structures of various kinds imperfectly accommodate a greater or lesser number of individuals depending upon the incorporation of characteristic norms in their design and fabrication. As every individual has different anatomical features and characteristics, a pre-formed structure will not accommodate every individual to the same degree.

Moreover, recent research has revealed that soccer players are at risk of chronic traumatic brain injury due to repeated heading of the soccer ball. The cumulative trauma has a degenerative effect similar to that which has been observed in boxers. It should be recognized that a soccer ball can travel at approximately 60 miles per hour and impact the head with a force of 175 pounds. The following studies have documented this phenomenon:

J. T. Maser et al., "Chronic Traumatic Brain Injury In Professional Soccer Players," *Neurology*, 1998, September; 51 (3): pages 791–796.

A. T. Tysvaer et al., "Head and Neck Injuries Among Norwegian Soccer Players. A Neurological, Electroencephalographic, Radiologic and Neuropsychological Evaluation," *Tidsskr Nor Laegeforen*, Apr. 10, 1992;112 (10): pages 1268–1271.

A. T. Tysvaer, "Head and Neck Injuries In Soccer. Impact of Minor Trauma," *Sporis Medicine*, Sep. 14, 1992, 14(3): pages 200–213.

A. T. Tysvaer et al., "Soccer Injuries to the Brain. A Neuropsychological Study of Former Soccer Players," *American Journal of Sports Medicine*, 1991, January–February; 19 (1): pages 56–60.

A. T. Tysvaer et al., "Soccer Injuries to the Brain. A Neurologic and Electroencephalographic Study of Active Football Players." *American Journal of Sports Medicine*, 1989, July–August; 17 (4): pages 573–578.

O. Sortland, et al., "Brain Damage in Former Association Football Players. An Evaluation by cerebral Computed Tomography," *Neuroradiology*, 1989; 31 (1): pages 44–48.

B. P. Boden, et al., "Concussion Incidence in Elite College Soccer Players," *American Journal of Sports Medicine*, 1998, March–April; 26 (2): pages 238–241.

There is then a need for a novel protective helmet for use in soccer that will at least partially attenuate the impact which takes placed when a soccer ball is headed. Further, it can be readily understood that it would be advantageous that such a helmet closely conform to the anatomical features of the wearer's head and permit control of the soccer ball while heading.

There have been attempts to made custom molded articles of protective equipment having a permanent memory capability, in particular, U.S. Pat. No. 5,732,713, U.S. Pat. No. 5,454,780, U.S. Pat. No. 5,544,663, granted to Jeffrey Duback et al. which are directed to the making of a shin-guard, and U.S. Pat. No. 4,292,263 granted to James Hanrahan, et al. directed to the making of protective padding. Further, there are numerous patents directed towards the making of casts or braces held by "3M," that is, Minnesota Minning and Manufacturing Company of St. Paul, Minn., e.g., U.S. Pat. No. 4,667,661, U.S. Pat. No. 4,683,877, U.S. Pat. No. 4,774,937, U.S. Pat. No. 4,856,502, U.S. Pat. No. 4,888,225, U.S. Pat. No. 4,946,726, U.S. Pat. No. 5,002,047, and U.S. Pat. No. 5,042,464.

In addition, the present inventor's U.S. Pat. No. 4,674,206, U.S. Pat. No. 5,101,580, U.S. Pat. No. 5,203,793, and in particular, U.S. Pat. No. 5,632,057, include teachings relating to the customization of footwear components, all of these patents hereby being incorporated by reference herein. The present application is a Continuation-In-Part of a Continuation of U.S. Pat. No. 5,632,057 which was granted on May 17, 1997. It was anticipated in the applicant's U.S. Pat. No. 5,632,057, column 37, lines 33–46, that the teachings contained therein with respect to the use of light-cure materials could be applied to the general subject matter of the present application. U.S. Pat. No. 3,905,376, granted to Amcis Johnson et al., hereby incorporated by reference herein, teaches various custom prosthetic devices including light cure material having permanent memory. U.S. Pat. No. 4,512,340, granted to Carl Buck, hereby incorporated by herein, teaches the use of light cure materials in making casts.

The procedures and methods associated with: many previous attempts to make custom molded articles of protective equipment having a permanent memory capability have been relatively complex, time consuming, expensive, or otherwise not amenable to mass production and use by the general public. Accordingly, it is an object of the present invention to provide a fast, easy, effective and inexpensive method of making custom molded articles of protective equipment having a permanent memory capability.

SUMMARY OF THE INVENTION

The present invention teaches novel articles of protective equipment including light cure material. The present invention can provide a fast, easy, inexpensive method of making custom molded articles of protective equipment having a permanent memory capability. Accordingly, the present invention can be used to make protective athletic equipment such as shin-guards, pads, helmets, and prosthetic devices such as back supports and wrist guards.

The present invention teaches a preferred shin-guard including a light cure material. The light cure material can be contained in a bladder comprising a thermoplastic film such as polyurethane. A foam material having peaks and valleys can be included within the bladder. The bladder of a shin-guard can include a void containing a gas or mixture of gases. Alternately, the film comprising the outer layer of the bladder can be affixed to a foam material. Alternately, a shin-guard can include an inner bladder and an outer bladder configured in an overlapping relationship. Alternately, a shin-guard can include two bladder configured in a side-by-side relationship. Alternately, a shin-guard can include a textile material. The textile material can be stretchlastic. The textile material can be impregnated with a light cure material to comprise an impregnated textile material. The textile material can be contained in a bladder, or alternately, can comprise the outer surface of a shin-guard. A shin-guard can further include a posterior guard for protecting the achilles tendon, and one or more side guards for protecting the malleoli. A shin-guard can be inserted into the pocket of a sock and donned on a wearer.

The present invention teaches a preferred pad including a bladder containing light cure material, and can comprise knee pads, thigh pads, hip pads, rib guards, shoulder pads, elbow pads, biceps pads, forearm pads, gloves, neck guards, face guards, chin straps and guards, wrist guards, braces, and helmets. Alternately, a preferred pad can comprise an impregnated textile material.

The present invention teaches a preferred chin strap including a bladder containing light cure material. Alternately, a preferred chin strap can comprise an impregnated textile material.

The present invention teaches a preferred back support including a bladder containing light cure material. Alternately, a preferred back support can comprise an impregnated textile material.

The present invention teaches a preferred wrist guard including a bladder containing light cure material. Alternately, a preferred wrist guard can comprise an impregnated textile material.

The present invention teaches a preferred helmet liner comprising light cure material. The light cure material can be contained in a bladder comprising a thermoplastic film such as polyurethane. A foam material having peaks and valleys can be included within the bladder. The bladder can include a void containing a gas or mixture of gases. Alternately, the film comprising the outer layer of the bladder can be affixed to a foam material. Alternately, a helmet liner can include an inner bladder and an outer bladder configured in an overlapping relationship. Alternately, a helmet liner can include two bladders configured in a side-by-side relationship. Alternately, a helmet liner can include a textile material. The textile material can be stretchlastic. The textile material can be impregnated with a light cure material to comprise an impregnated textile material. The textile material can be contained in a bladder, or alternately, can comprise the inner surface or outer surface of a helmet liner. A helmet liner can include temporal and sphenoidal bladders for protecting the sides of the head proximate the temple and ear, an occipital bladder for protecting the back of the head, a parietal bladder for protecting the top of the head, and a frontal bladder for protecting the front of the head. Alternately, the parietal bladder and frontal bladder can both be made in two generally opposing bladders or chambers each protecting their respective medial or lateral aspect of the head. A helmet liner can be inserted and affixed to the outer shell of a helmet.

The present invention leaches a preferred helmet including light cure material. A helmet can comprise an outer shell and a helmet liner. A helmet can include a plurality of segments comprising at least a temporal and sphenoidal segment for protecting the sides of the head proximate the temple and ear, an occipital segment for protecting the back of the head, a parietal segment for protecting the top of the head, and a frontal segment for protecting the front of the head. The segments can include a light cure material therebetween. The helmet can comprise an outer surface which is textured, tactified, and includes raised grip elements, in partial or complete combination. A helmet can include a textile material. The textile material can be stretchlastic. The textile material can be impregnated with a light cure material to comprise an impregnated textile material. The impregnated textile material can be contained in a bladder, or alternately, can comprise the outer surface of a helmet. The helmet can include a thin layer of protective film.

A preferred method of making an article of protective equipment such as a shin-guard, pad, chin guard, back support, wrist guard, helmet liner, or helmet comprising a light cure material can include the following steps:

a) Opening a container which is substantially impenetrable to light and removing an article of protective equipment including a lightcure material;

b) Placing the article of protective equipment in position upon a wearer; and, c) Exposing the article of protective equipment to light causing the light-cure material to cure.

BRIEF DESCRIPTION OF THE DRAWINGS

FIG. 15 is a top plan view of an elbow pad including a light cure material.

FIG. 16.1 is a perspective view of the bones of an infant skull.

FIG. 16.2 is a perspective view of the bones of an adult skull.

DETAILED DESCRIPTION OF THE PREFERRED EMBODIMENTS

The present invention teaches novel articles of apparel and protective equipment including light cure materials having a permanent memory capability. The resulting articles can protect a wearer from impact events and possible injury. Accordingly, the present invention can be used to make protective equipment including but not limited to shin-guards, knee pads, elbow pads, helmets, and prosthetic devices.

Figure 1:
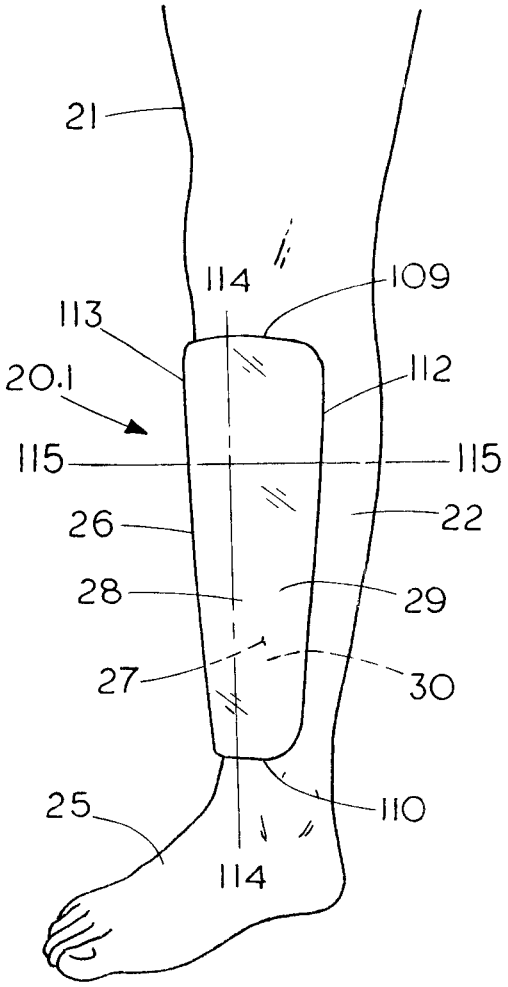
FIG. 1 is a perspective view of a shin guard including a bladder containing light cure material positioned on a wearer.
Figure 6:
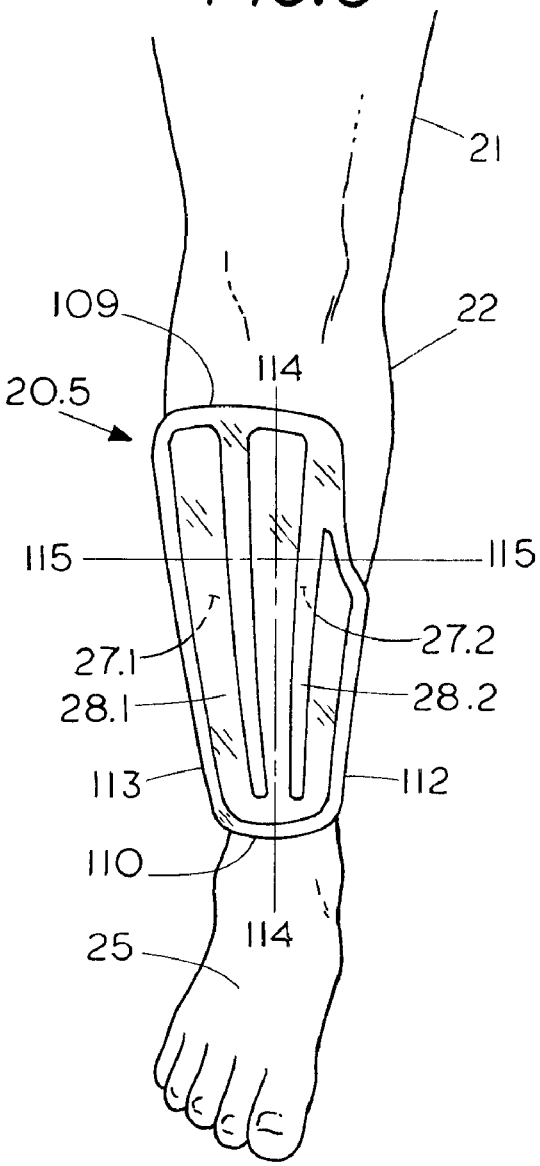
FIG. 6 is a front plan view of a shin guard including two bladders configured in a side-by-side relationship containing two light cure materials having different physical and mechanical properties.
Figure 10:
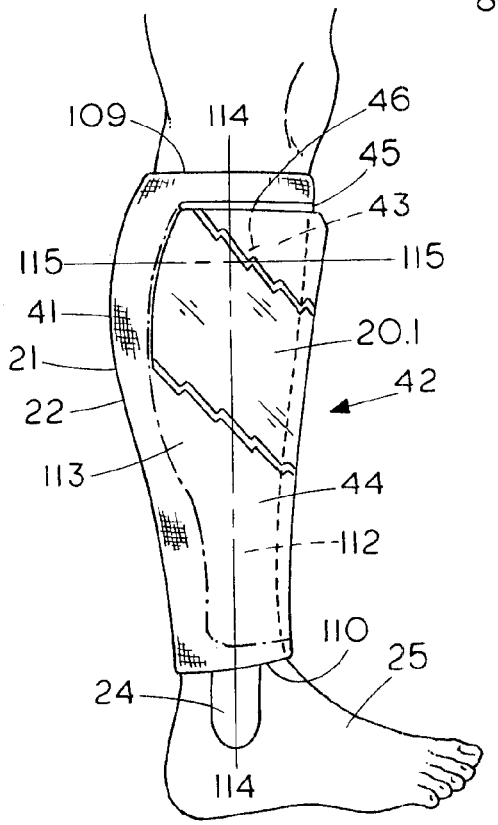
FIG. 10 is a perspective view of a sock made of textile material, with parts broken away, and including means for securing a shin guard.

FIG. 1 is a perspective view of a preferred shin guard 20.1 including a light cure material 27 positioned, on the lower leg 22 of a wearer 21. In FIGS. 1, 6 and 10 the shin guards 20.1 and 20.5 are shown as having a superior side 109, an inferior side 110, a medial side 112, a lateral side 113. Also the longitudinal axis 114, and transverse axis 115 of the shin guard are shown. Shin guard 20.1 can be made of a thermoplastic material such as a thin flexible film 26 which is sealed about any mating edges so as to create a bladder 28. The preferred film 26 for a bladder 28 consists of polyurethane and can range in thickness between 5–50 mils, depending upon the particular application. The film 26 can be sealed by radio frequency welding, heat and pressure welding, adhesive, and the like. The outer layer 29 of the bladder 28 faces generally opposite the inner layer 30 of the bladder 28, the former being more distant and the latter being closest to the wearer's body. Preferably, at least the outer layer 29 of the bladder 28 is made of a substantially transparent film 26 that permits the transmission of light therethrough. A light-cure material 27 in a substantially liquid or viscous state is contained within bladder 28. The shin-guard 27 can be contained in a closed container for storage or shipping such as a jar, box, bag, package or sealed pouch, and the like, that does not substantially permit the transmission of ultraviolet and visible light. Such a container can be said to be substantially impermeable or impenetrable to ultraviolet and visible light. A package or sealed pouch including a thin plastic film including metallic foil can be advantageous for use. When shin-guard 20.1 is removed from a closed container or package and donned by a wearer 21, exposure of the shin guard 20.1 to a visible or ultraviolet light source such as sunlight, or a suitable man-made light source will cause the light cure material 27 contained within the bladder 28 to cure and form substantially solid matter.

Light is herein defined as electromagnetic radiation having a wavelength between 280 and 780 nanometers, thus includes a substantial portion of the ultraviolet and visible light spectrum. It can be advantageous to use natural sunlight or man made visible light having a wavelength between 400 and 780 nanometers, since it is possible for man made ultraviolet light to cause injury to skin and eye tissue.

Suitable man-made light sources for curing, include, but are not limited to fluorescent lamps. When a "blue" light photoinitiator such as "H-NU 470" made by Spectra Group Limited of Maumee, Ohio, is used to trigger the light cure reaction, fluorescent lamps having substantial spectral power in the blue light region can be advantageous for use, such as "Daylight/6500K," "Colortone 50/5000K," "Colortone 75/7500K," those identified as "Actinic" or "SuperActinic", and in particular "Special Blue," made by the Phillips Lighting Company of Somerset, N.J. Similar florescent lamps are made by General Electric, Westinghouse, and Osram/Sylvania. Another manufacturer of visible light photoinitiators is Ciba Specialty Chemicals of Tarrytown, N.Y. Suitable Ciba visible light photoinitiators include IRGACURE® 184, and in particular, IRGACURE® 784. Suitable Ciba ultraviolet light photoinitiators include IRGACURE® 369, and 819.

Suitable light cure materials having a wide range of physical and mechanical characteristics are made, e.g., by Dow Corning Corporation of Midland, Mich., UVEX, Inc. of Sunnyvale, Calif., Sartomer, Inc. of Exton, Pa., "3M"

Minnesota Mining Company of St. Paul, Min., Loctite Corporation of Rocky Hill, Conn., and Borden, Inc. of Columbus, Ohio. For example, "Q3-6696" made by Dow Corning Corporation, or "3584" made by Loctite Corporation, and the like, can be suitable for use as a relatively,soft, flexible, and shock, absorbing light cure material, whereas "3102" or "3106" made by Loctite Corporation can be suitable for use as relatively rigid and non-flexible light cure material. Another major manufacturer of light cure materials known by the EBERCRYL® trademark is UCB Radeure of Smyrna, Ga.

Figure 2:
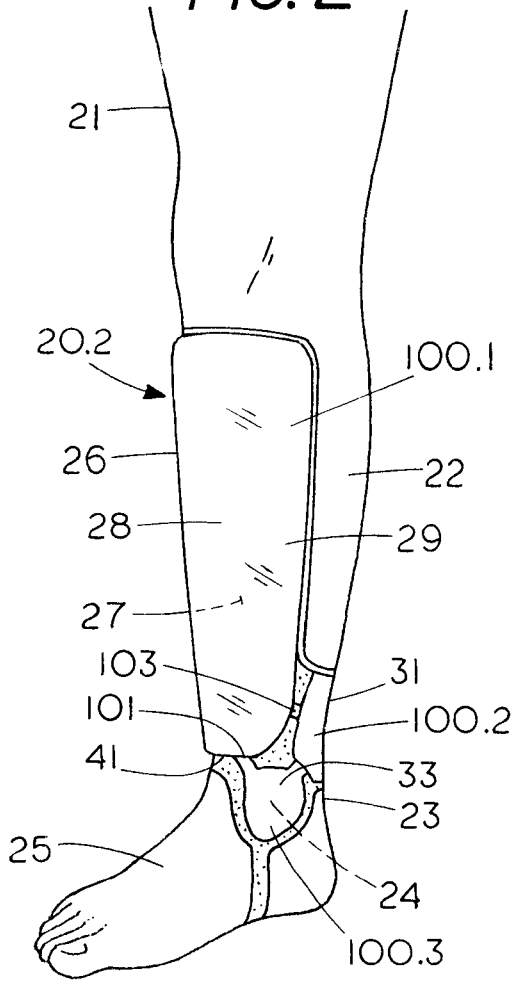
FIG. 2 is a perspective view of an alternate shin guard including a bladder containing light cure material positioned on a wearer.

FIG. 2 is a perspective view of an alternate preferred shin guard 20.2 including a light cure material 27 positioned on the lower leg 22 of a wearer 21. Alternate shin guard 20.2 can include a posterior guard 31 for protecting a portion of the achilles tendon 23, and/or side guards 33 for protecting the malleolli 24. As shown in FIG. 2, shin guard 20.2 can include separate chambers, such as chambers 100.1, 100.2, and 100.3, connected by passages 103 which can be sealed off by welds 101, as desired. Alternately, shin guard 20.2 including posterior guard 31 and side guard(s) 33 can consist of completely separate bladders.

Figure 3:
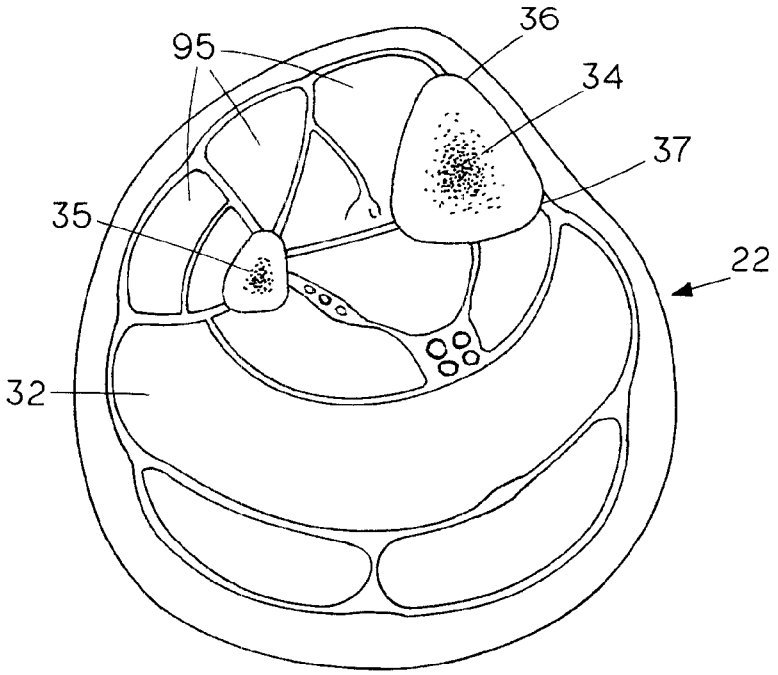
FIG. 3 is a cross-sectional view of the lower, left leg of a wearer, taken along the transverse axis.

FIG. 3 is a cross-sectional view taken along the transverse plane of a wearer's lower leg 22 taken from *Atlas of Human Anatomy*, by Frank H. Netter, M.D., 1989., plate 491, showing the asymmetrical shape of the lower leg 22. Also shown is the location of the tibia 34, fibula 35, and a plurality of muscles 32 of the lower leg 22. A preferred shin guard 20 can provide protection for the tibia 34, in particular along the vulnerable anterior edge 36 and medial edge 37, and to the anterior muscles of the lower leg 22.

Figure 4:
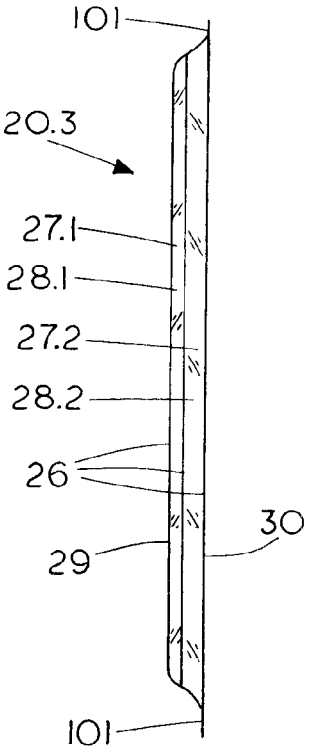
FIG. 4 is a cross-sectional side view of a shin guard including two bladders configured in an overlapping relationship containing two light cure materials having different physical and mechanical properties.

FIG. 4 is a cross-sectional side view of an alternate shin guard 20.3 including a first light cure material 27.1 contained in outer bladder 28.1, and a second light cure material 27.2 having different physical and mechanical properties contained in inner bladder 28.2. The bladders are configured in a overlapping relationship. Light cure material 27.1 contained in outer bladder 28.1 can form a relatively rigid material, and light cure material 27.2 contained in inner bladder 28.2 can form a relatively soft, flexible and resilient material when cured. As shown, shin guard; 20.3 can be formed by three layers of film 26 which are affixed together using radio frequency welding, or alternately, can be formed in two separate bladder portions. When shin guard 20.3 consists of a single integral unit, it can be advantageous that the light cure material 27.1 used in outer bladder 28.1 not cure prior to the cure of the light cure material 27.2 used in inner bladder 28.2, and/or the light cure material 27.1 should be substantially transparent or otherwise permit adequate light energy to reach light cure material 27.2 in order to cause it to cure. When shin guard 20.3 is formed in two separate bladder portions, the inner bladder 28.2 can be donned by a wearer and cured, then the outer bladder 28.1 be donned and secured in functional relation thereto and cured. The two separate bladder portions can be affixed to one another with the used of a self-adhesive material, light cure adhesive material, snap, friction fit, VELCRO® hook an pile, or other conventional mechanical means, and the like.

Figure 5:
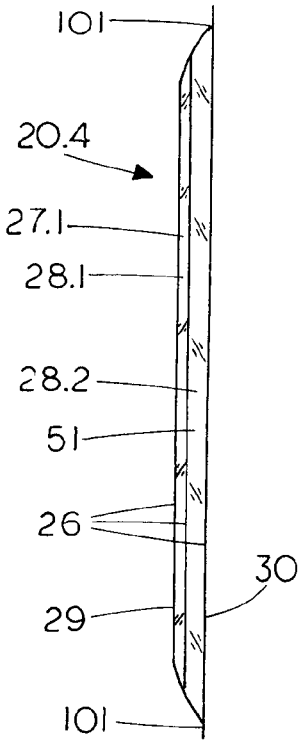
FIG. 5 is a cross-sectional side view of a shin guard including a bladder containing a gas.

FIG. 5 is a cross-sectional view of a shin guard 20.4 including an inner bladder 28.2 containing a void 50 that is filled with a gas 51. Other articles of protective equipment such as guards, pads, and helmets can include a bladder 28 containing a light cure material 27 and a gas 51, or a mixture of gases such as air. Filler materials such as glass fibers, carbon fibers, or microspheres can also be included. A captive gas 51 or a mixture of gases can be pressurized above, below, or at atmospheric pressure. As shown, outer bladder 28.1 and inner bladder 28.2 are configured in an overlapping relationship. Light cure material 27.1 contained in bladder 28.1 can form a relatively rigid material when cured. Shin guard 20.4 can be formed by three layers of film 26 which are welded together using radio frequency, or can be formed in two separate bladder portions.

Gas filled bladders taught by Marion F. Rudy and licensed to NIKE, Inc. include U.S. Pat. No. 5,543,194, U.S. Pat. No. 5,083,361, U.S. Pat. No. 5,042,176, U.S. Pat. No. 4,936,029, U.S. Pat. No. 4,906,502, U.S. Pat. No. 4,340,626, U.S. Pat. No. 4,287,250, U.S. Pat. No. 4,271,606, U.S. Pat. No. 4,219,945 and U.S. Pat. No. 4,183,156, all of these patents being hereby incorporated by reference herein Gas filled bladders or pads taught by Byron Donzis include U.S. Pat. No. 5,235,715, U.S. Pat. No. 4,874,640, U.S. Pat. No. 4,513,449, U.S. Pat. No. 4,486,901, U.S. Pat. No. 4,453,271, U.S. Pat. No. 4,441,211, U.S. Pat. No. 4,370,754, and U.S. Pat. No. 4,217,705, all of these patents being hereby incorporated by reference herein. Teachings related to athletic equipment by J. C. Wingo include U.S. Pat. No. 5,036,761, U.S. Pat. No. 5,035,009, U.S. Pat. No. 5,029,341, U.S. Pat. No. 4,985,931, U.S. Pat. No. 4,926,503, and U.S. Pat. No. 4,872,216, all of these patents being hereby incorporated by reference herein.

FIG. 6 is a front perspective view of a shin guard 20.5 including two bladders 28.1, and 28.2, configured in a side-by-side relationship, and containing light cure materials having different physical and mechanical properties. Light cure material 27.1 contained in bladder 28.1 can form a relatively rigid material, and light cure material 27.2 contained in bladder 28.2 can form a relatively soft, flexible and resilient material when cured. The shin guard 20.5 can be characterized by alternating areas of relative rigidity and flexibility, thus permitting the shin guard 20.5 to easily conform to the anatomy of a wearer, and to accommodate the flexion of leg muscles associated with movement.

In addition, a shin guard can be combined with a knee guard and formed as an integral unit, and a flexible light cure material can be used therebetween and proximate the knee so as to permit flexion. Nevertheless, the knee and shin can be substantially protected by rigid material. It can then be readily understood that the present invention can be used to make articulating body armor, and like guards, and pads. An example of a combination batter's shin and ankle guard is taught in U.S. Pat. No. 5,742,938 assigned to Rawlings, Inc., hereby incorporated by reference herein.

Figure 7:
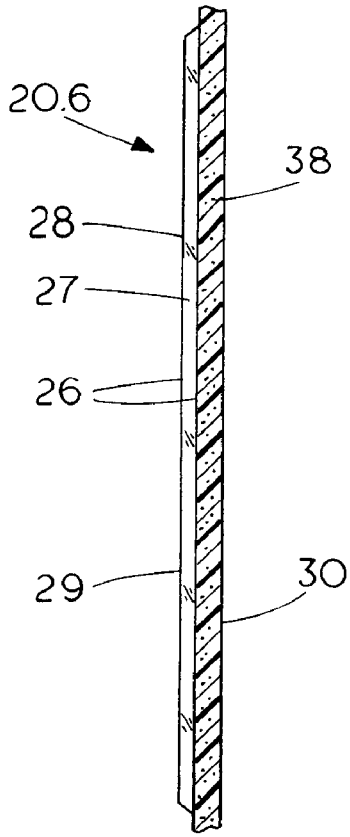
FIG. 7 is a side cross-sectional view of a shin guard including a bladder containing a light cure material that is affixed to a foam material.

FIG. 7 is a side cross-sectional view of a shin guard 20.6 having a bladder 28 including a flight cure material 27. The bladder 28 consists of a relatively thin and substantially transparent film 26 that is affixed to a different material, such as a textile material 41, or as shown, a foam material 38. The foam material 38 can consist of an open or closed cell foam. The preferred foam 38 can consist of polyurethane, ethylene vinyl acetate, or a foam rubber. The bladder 28 can be affixed to the foam material 38 by sewing, adhesive, self-adhesive, light cure material, radio frequency, microwave, or ultrasound welding, heat and pressure welding, and other conventional means. A foam material 38 can be made in a complex and generally anatomically conforming shape, including, but not limited to the method taught in U.S. Pat. No. 5,118,722 assigned to Illbruck Gmbf, hereby incorporated by reference herein.

Figure 8:
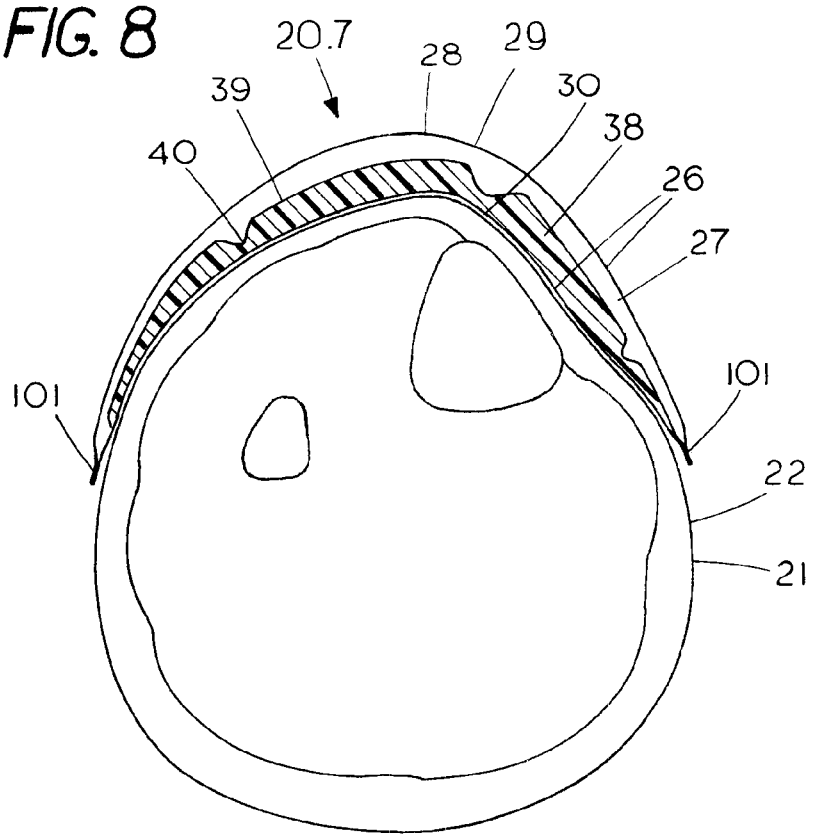
FIG. 8 is a transverse cross-sectional view of a shin guard including a bladder containing light cure material and a foam material.

FIG. 8 is a transverse cross-sectional view of a shin guard 20.7 including a bladder 28 containing light cure material 27 and a foam material 38. The foam material 38 is preferably a substantially closed cell or microcellular foam. The foam material 38 can be characterized by various contours and features such as peaks 39 and valleys 40, thus the relative proportion of foam material 38 and light cure material 27 can be engineered to vary in any given portion of the shin guard 20.7, as desired. The resulting shin guard 20.7 will then be heterogeneous, that is, be characterized by different physical and mechanical properties in different select locations, as desired. The foam material 38 can be affixed to the outer side of the film 26 used on the inner layer 30 of the bladder 28 by adhesive, self-adhesive, light cure material, or radio frequency, microwave, or ultrasound welding, heat and pressure, and the like. As shown, the film 26 forming the both the inner layer 30 of the bladder 28 and the outer layer 29 of the bladder 28 can be affixed at mating edges by welds 101.

Figure 9:
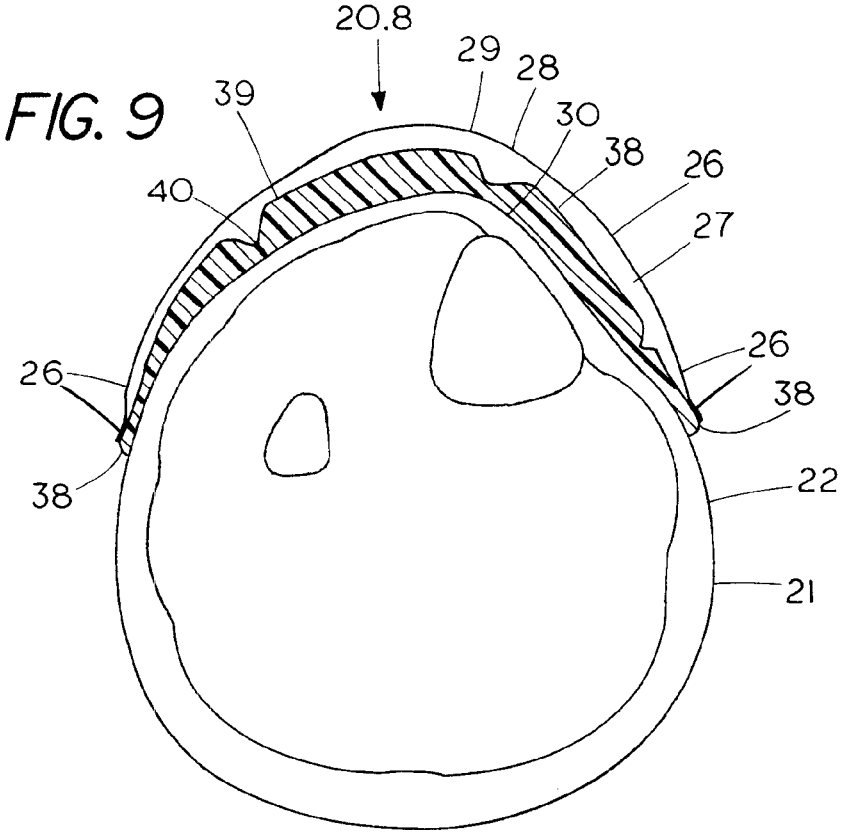
FIG. 9 is a transverse cross-sectional view of a shin guard including a bladder made from a substantially transparent film material affixed to a foam material, and containing a light cure material.

FIG. 9 is a transverse cross-sectional view of a shin guard 20.8 including light cure material 27 within a bladder 28 that is made of a substantially transparent material affixed to a relatively non-transparent material. The non-transparent material can be made of a substantially closed cell or microcellular foam material 38, a natural or synthetic fiber material, a textile material 41, a thermoplastic material, a thermoset material, or a natural or synthetic rubber, and the like. The relatively non-transparent material, e.g., a foam material 38, can be characterized by various contours and features such as peaks 39 and valleys 40, thus the proportion of foam material 38 and light cure material 27 can be engineered to vary in any given portion of the shin guard 20.8, as desired. The resulting shin guard 20.8 will then be heterogeneous, that is, characterized by different physical and mechanical properties in different select locations, as desired. The substantially transparent film 26 can be affixed to the outer side of the foam material 28 by adhesive, self-adhesive, light cure material, radio frequency, microwave, or ultrasound welding, heat and pressure, and the like. As shown, the film 26 forming the both the inner layer 30 of the bladder 28 and the outer layer 29 of the bladder 28 can be affixed at mating edges by welds 101.

FIG. 10 is a perspective view of a sock 42 made of textile material 41 with parts broken away, including means for securing a shin guard 20.1 in functional relation thereto. The sock 42 can include an inside layer 43 and an outside layer 44 and have an access point 45 to a sleeve or pocket 46 in which the shin guard 20.1 can be positioned. The inside layer 43 and outside layer 44 of the sock 42 can be affixed together by conventional means at an inferior portion near the malleolli 24, or alternately, near the superior portion of the sock 42. In the first case, the outside layer 44 can be rolled down in order to secure the shin guard 20.1 in place, and in the second case, the outside layer 44 can be rolled up in order to accomplish the same. Alternately, the inside layer 43 and outside layer 44 of the sock 42 can consist of a single component which forms two or more layers by simply folding and doubling the sock 42 over upon itself The shin guard 20.1 can be positioned and held in place in relation to the sock 42 with the use of friction fit, snaps, straps, VELCRO® hook and pile, zipper, self-adhesive, adhesive, or other conventional means.

When it is desired to form an new shin guard 20.1 in conformance with a wearer's anatomy, the shin guard 20.1 including light-cure material 27 can be removed from a container in which it is stored and shipped that does not permit the passage of substantial ultraviolet or visible light therethrough, and then placed in position on the wearer's lower leg 22 with or without the presence of sock 42. Exposure of the shin guard 20.1 to sunlight or a suitable man-made light source can cause the shin guard 20.1 to cure in less than 5 minutes. Depending upon the configuration of the shin guard 20.1, it can sometimes be advantageous for the wearer to engage in movement while the light cure material 27 is being caused to cure in order to better accommodate the flexion of the wearer's muscles. When the shin guard 20.1 has been positioned in functional relationship to a sock 42, and the like, the outside layer 44 of the sock 42 can be rolled up or down, the light cure material 27 be caused to cure, and then the outside layer 44 of the sock 42 can simply be rolled back up or down and into place. Essentially, all that a consumer or wearer has to do is to put the shin guard 20.1 on and go out and play. The technology associated with the creation of a customized shin guard having a permanent memory capability thus largely takes care of itself The process is quick, clean, easy, effective, and inexpensive.

Figure 11:
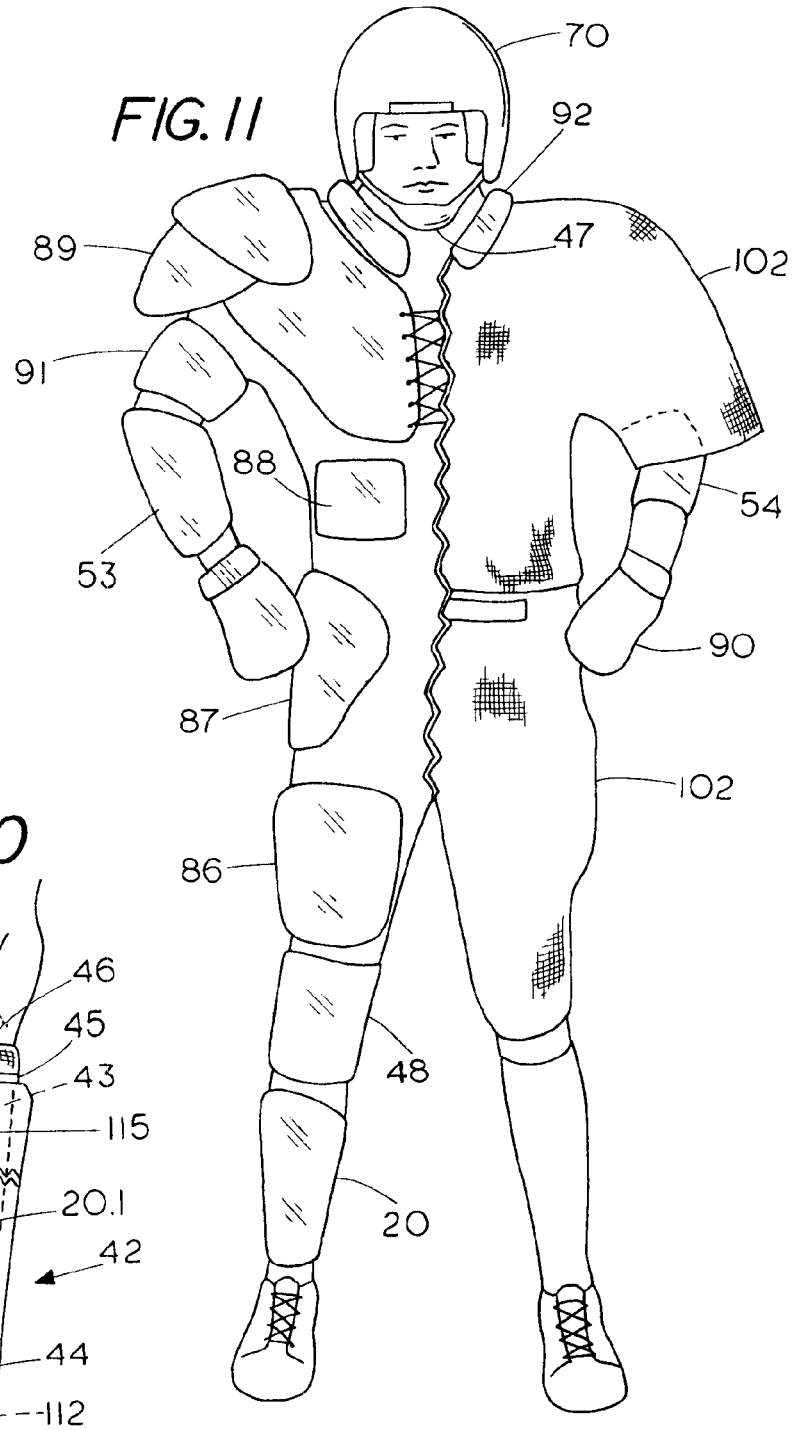
FIG. 11 is a front view of a football player wearing a plurality of pads, with parts of his uniform broken away.

FIG. 11 is a front or anterior view of a football player wearing a helmet 70, a uniform 102 with parts broken away, and a plurality of guards or pads. Shown are shin guard 20, knee pad 48, thigh pad 86, hip pad 87, rib pad 88, shoulder pad 89, elbow pad 54, glove 90, forearm pad 53, biceps pad 91, neck pad 92, helmet 70, and chin strap 47. All of the aforementioned guards, pads, and other articles of apparel and protective equipment can be made to include a light cure material for effecting a custom fit.

Figure 12:
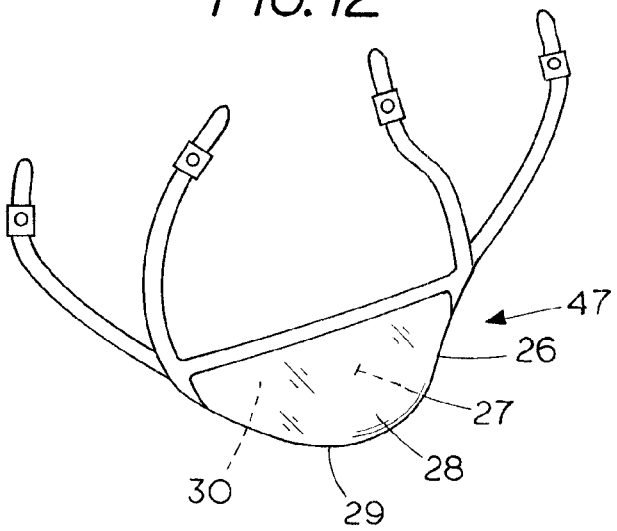
FIG. 12 is a perspective view of a chin-strap including a light cure material.

FIG. 12 is a perspective view of a chin-strap 47 including light cure material 27. Examples of chin guards and straps known in the art include U.S. Pat. No. 5,794,274, and U.S. Pat. No. 4,646,368 assigned to Riddell, Inc. As shown, the chin strap 47 can include a flexible bladder 28 including light cure material 27, and the outer layer 29 of the bladder 28 can include a substantially transparent material. Alternately, the chin strap 47 can include a textile material which is impregnated with a light cure material. Accordingly, when it is desired to form a chin strap 47 in conformance with a wearer's anatomy, the chin strap 47 including light cure material 27 can be removed from a container in which it is stored and shipped that does not permit the passage of substantial ultraviolet or visible light therethrough, and the wearer can simply attach the chin strap 47. In the presence of sunlight or ambient light conditions the light cure material 27 can be caused to cure and capture the anatomical features of the wearer. It can be advantageous that the inner layer 30 of the bladder of chin strap 47 be made of a stretchlastic or otherwise flexible material capable of elongation and distention so as to accommodate the anatomical features of the wearer.

Figure 13:
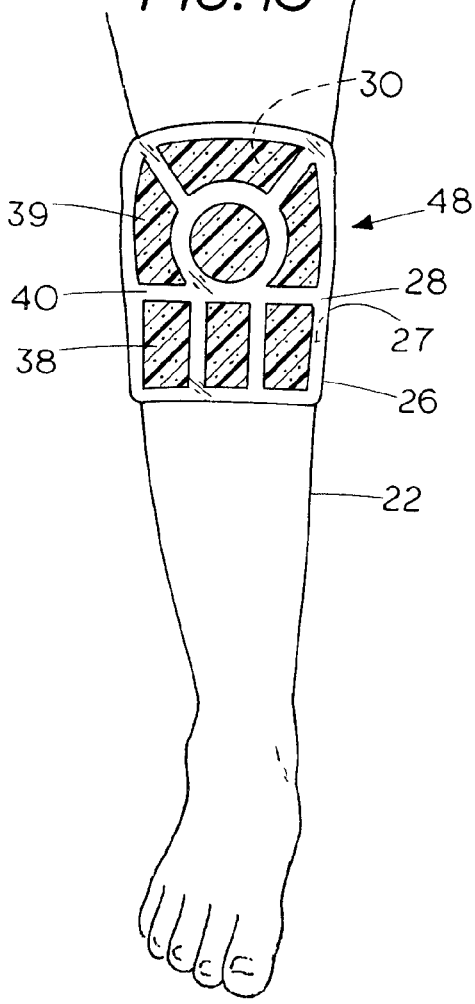
FIG. 13 is a perspective view of knee pad including a light cure material.

FIG. 13 is a perspective view of a preferred knee pad 48 including a bladder 28 containing a light cure material 27. The material used as the inner layer 30 of the bladder 28 of knee pad 48 can include peaks 39 and valleys 40 which can be substantially encapsulated by the light cure material 27. The inner layer 30 of the knee pad 48 can be made of a foam material 38. The preferred foam material 38 is made of a substantially closed cell or microcellular foam. The foam material 38 can be characterized by various contours and features such as peaks 39 and valleys 40, thus the proportion of foam material 38 and light cure material 27 can be engineered to vary in any given portion of the knee pad 48. The resulting knee pad 48 will then be heterogeneous, that is, characterized by different physical and mechanical properties in different select locations, as desired. Alternately, the inner layer of the knee pad can be made of a natural or synthetic fiber material, a textile material, a thermoplastic material, a thermoset material, a natural or. synthetic rubber, and the like. It can be advantageous that the inner layer 30 of the bladder 28 of knee pad 48 be made of a stretchlastic material 93 or otherwise flexible material capable of elongation and distention so as to accommodate the anatomical features of the wearer 21. The substantially transparent film 26 can be affixed to the outer side of the foam material 38 or other material used to make the inner layer 30 of the bladder 28 by adhesive, self-adhesive, light cure adhesive, radio frequency, microwave, or ultrasound welding, heat and pressure, and the like.

Figure 14:
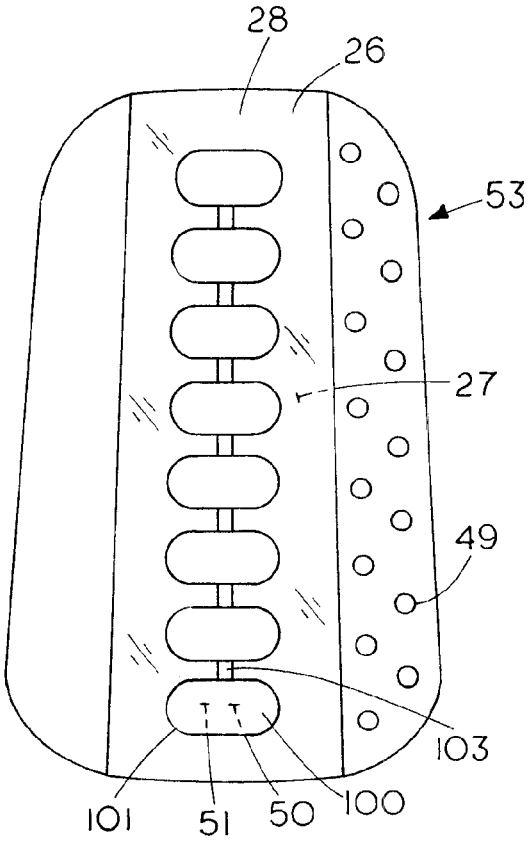
FIG. 14 is a top plan view of a forearm pad including a light cure material.

FIG. 14 is a top plan view of a forearm pad 53 including light cure material 27. Shown on the right side of the forearm pad 53 are openings 49 for permitting heat dissipation and evaporation of sweat. Shown in the middle portion of the forearm pad 53 is a plurality of voids 50 filled with a gas 51 for attenuating force applications. The captive gas can be at atmospheric pressure, or greater" than atmospheric pressure. The voids 26 can constitute chambers 101 which are at least initially interconnected by passages 103. The chambers 101 and passages 103 can be formed by radio frequency welding of the film 26 which forms at least the outer layer 29 of the bladder 28. The chambers 101 can be filled with a gas and then isolated by welds 101 made to block passages 103, as desired.

FIG. 15 is a top plan view of an elbow pad 54 including a bladder 28 containing light cure material 27. The material used as the inner layer 30 of elbow pad 54 includes peaks 39 and valleys 40 which permit the light cure material 27 to substantially encapsulate the inner layer 30 of the elbow pad 54. The inner layer 30 of the elbow pad 54 can be made of a foam material 38. The foam material 38 is preferably a substantially closed cell or microcellular foam. The foam material 38 can be characterized by various contours and features such as peaks 39 and valleys 40, thus the proportion of foam. material 38 and light cure material 27 can be engineered to vary in any given portion of the elbow pad 54. The resulting elbow pad 54 can then be heterogeneous, that is, characterized by different physical and mechanical properties in different select locations, as desired. Alternately, or in addition to inclusion of a foam material 38, the inner layer 30 of the elbow pad 54 can be made of a natural or synthetic fiber material, a textile material, a thermoplastic material, a thermoset material, a natural or synthetic rubber, and the like. It can be advantageous that the inner layer 30 of the elbow pad 54 be made of a stretchlastic 93 or otherwise flexible material capable of elongation and distention so as to accommodate the anatomical features of the wearer. The substantially transparent film 26 can be affixed in function relation to the outer side of the foam material 38 or other material used to make the inner layer 30 of the bladder 28 by adhesive, self-adhesive, light cure adhesive, radio frequency, microwave, or ultrasound welding, heat and pressure, and the like.

FIGS. 16.1 and 16.2 are perspective views showing the bones of the skull 56 of a newborn in FIGS. 16.1 and a mature adult in FIG. 16.2. Shown are the skull 56, occipital bone 57, parietal bone 58, temporal bone 59, sphenoid bone 60, frontal bone 61, anterior fontanelle 62, posterior fontanelle 63, sagittal suture 96, coronal suture 64, lambdoid suture 65, squamous suture 66, sphenoidal fontanelle 67 and mastoid fontanelle 68. By adulthood, the various fonanelles of the skull are normally transformed into bone and disappear, and the sutures of the skull will close.

However, some individuals consider that the sphenoid and temporal bones can be capable of limited articulation even in an adult. In fact, it is believed that this portion of the skull 56 pulses several times per minute in connection with the circulation of cerebral-spinal fluid in the brain and spine, and serves to drive the large reservoirs of cerebral-spinal fluid that are contained within the brain cavity. Immobilization of these bones of the skull can then lead to headaches and mental disturbance, such as a diminished ability to concentrate. The tendency of individuals to rub their temples in order to relieve a headache is then an appropriate therapy, as prolonged muscle tension can have the effect of immobilizing or hindering normal articulation. In physical therapy, treatment based upon this phenomenon is known as craniosacral therapy. It can therefore be readily understood that a helmet which places significant pressure on the areas of the temporal or sphenoid bones, or about the base of the skull proximate the first vertebra can prove dysfunctional for use by a wearer.

Helmets known in the football prior art include U.S. Pat. No. 5,263,203, U.S. Pat. No. 5,175,889, U.S. Pat. No. 5,035,009, U.S. Pat. No. 4,831,668, U.S. Pat. No. 4,287,613, U.S. Pat. No. 3,866,243, assigned to Riddell, Inc. An adjustable baseball batter's helmet is taught in U.S. Pat. No. 5,575,017 assigned to Rawlings, Inc. An adjustable hockey helmet is taught in U.S. Pat. No. Des. 378,624 assigned to Canstar Sports Inc. Bicycle helmets made by Specialized Bicycle Components, Inc., PDH Corporation, Bell Sports, Inc., and Giro Sport Design, Inc., include U.S. Pat. No. 5,794,272, U.S. Pat. No. 5,381,560, U.S. Pat. No. 5,659,900, U.S. Pat. No. 5,481,762, U.S. Pat. No. 4,993,082, and U.S. Pat. No. 4,903,350. All of the U.S. Patents cited in this paragraph are hereby incorporated by reference herein.

Figure 17:
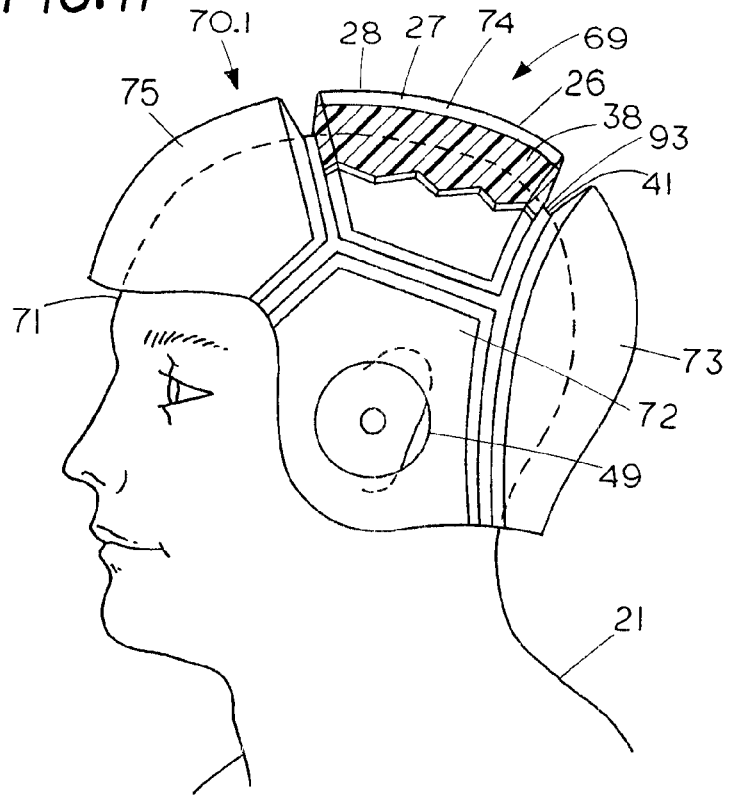
FIG. 17 is a perspective view of helmet liner including a light cure material, with parts broken away, positioned upon a wearer.

FIG. 17 is a perspective view of helmet liner 69 including a bladder 28 containing light cure material 27 positioned upon a wearer's head 71. The material used in that portion of the helmet liner 69 positioned against the head 71 can be substantially encapsulated by the light cure material 27. The material used proximate the head 71 can be a foam material 38. The foam material 38 is preferably a substantially closed cell or microcellular foam. The foam material 38 can be characterized by various contours and features such as peaks 39 and valleys 40, thus the proportion of foam material 38 and light cure material 27 can be engineered to vary in any given portion of the helmet liner 69. The resulting helmet liner 69 can then be heterogeneous, that is, characterized by different physical and mechanical properties in different select locations, as desired. Alternately, or in addition, the inner layer 30 of the helmet finer 69 can be made of a natural or synthetic fiber material, a textile material, a thermoplastic material, a thermoset material, a natural or synthetic rubber, and the like. It can be advantageous that the inner layer 30 of the helmet liner 69 be made of a stretchlastic 93 or otherwise flexible material capable of elongation and distention so as to accommodate the anatomical features of the wearer. The substantially transparent film 26 can be affixed to the foam material 38 or other material used to make the inner layer 30 of the bladder 28 by adhesive, self-adhesive, light cure adhesive, radio frequency, microwave, or ultrasound welding, heat and pressure, and the like.

It can be advantageous that the helmet liner 69 be made having several different bladders 28, or several different chambers 100 which generally imitate the position of the major bones of the skull 56, that is, two opposing temporal and sphenoidal bladders 72 protecting the sides of the head proximate the temple and ear, an occipital bladder 73 protecting the back of the head 71, a parietal bladder 74 protecting the top of the head 71, and a frontal bladder 75 protecting the front of the head 71. Alternately, the parietal bladder 74 and frontal bladder 75 can be made in two generally opposing bladders or chambers 100 each protecting their respective medial or lateral aspect of the head 71.

Many other configurations for a helmet liner 69 can be used. When the helmet liner 69 extends near or below the position of the ear, it can sometimes be advantageous that an aperture or opening 49 be provided so that the wearer's 21 hearing will not be significantly impaired. The aforementioned configuration of the helmet liner 69 facilitates conformance to the unique anatomical features of a wearer's head 71, due to the fact that the junction points between the respective bladders 28 or chambers 100 are located proximate the various sutures of the skull 56, and these areas are characterized by relatively thin cross-sections and resulting flexibility.

Figure 21:
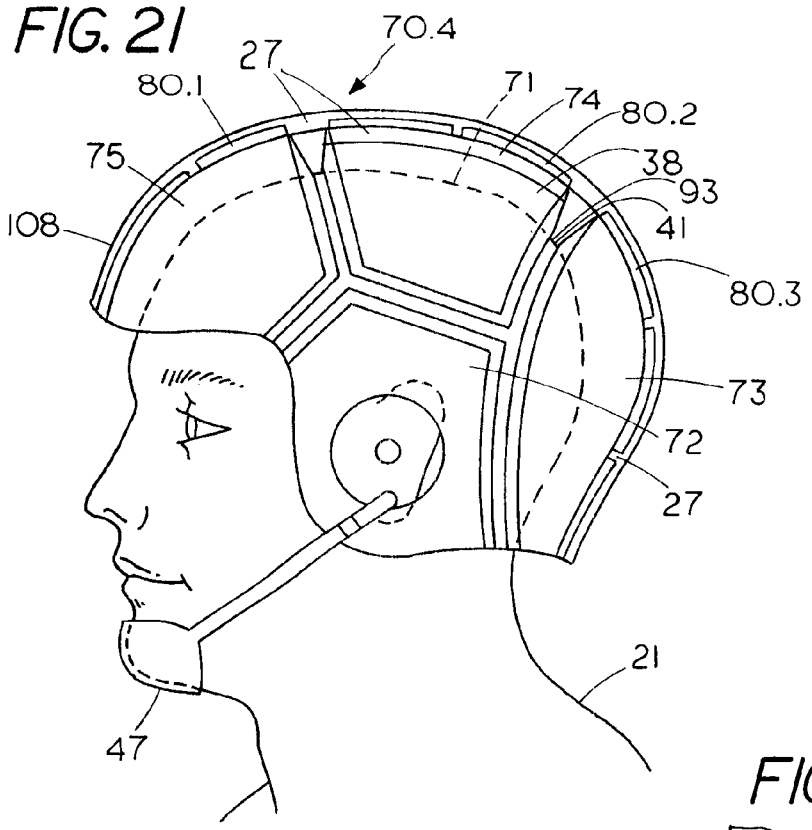
FIG. 21 is perspective view of a helmet including a plurality of segments that are substantially encapsulated by a light cure material, with parts broken away.

The wearer 21 can remove the helmet liner 69 including light cure material 27 from the container or package in which it is stored and shipped that does not permit the passage of substantial ultraviolet and visible light therethrough. When the various bladder 28 or chambers 100 are affixed in functional relation to a stretchlastic material 93, such as a stretchlastic textile material 41 which is used at least at the junction points between respective bladders 28 or chambers 100, the wearer 21 can simply don the helmet liner 69 and it will be caused to conform to their particular anatomical conformance, that is, the size and shape of their head 71. In the presence of sunlight or a suitable man-made light source, the light cure material 27 contained within helmet liner 69 can be caused to cure, thereby retaining a custom fit and permanent memory. As shown in FIG. 21, a helmet 70.4 or helmet liner 69 can include retaining means'such as a chin strap 47. Further, in some applications, it can be readily understood that the so-called helmet liner 69 shown in FIG. 17 can also constitute a suitable helmet 70.1 for use by a wearer 21. For this reason, drawing FIG. 17 has been identified as both la helmet liner 69, and a helmet 70.1.

Figure 18:
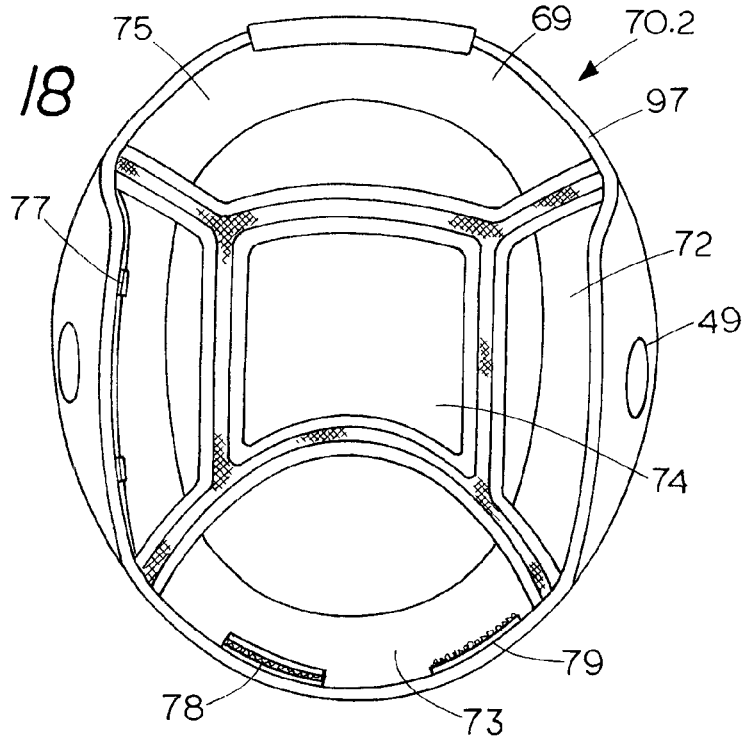
FIG. 18 is a bottom perspective view of a helmet liner secured in functional relation to a helmet.

FIG. 18 is a bottom perspective view of a helmet liner 69 secured in function relation to a relatively rigid outer shell 97 of a helmet 70.2 Shown are two opposing temporal and sphenoidal bladders 72 for protecting the sides of the head proximate the temple and ear, an occipital bladder 73 for protecting the back of the head, a parietal bladder 74 for protecting the top of the head 71, and a frontal bladder 75 for protecting the front of the head 71. Alternately, the parietal bladder 74 and frontal bladder 75 can be both be made in two generally opposing bladders 28 or chambers 100 each protecting their respective medial or lateral aspect of the head 71. The aforementioned configuration of the helmet liner 69 facilitates conformance to the unique anatomical features of a wearer's head 71, due to the fact that the junction points between the respective bladders 28 or chambers 100 are located proximate the various sutures of the skull 56, and these areas are characterized by relatively thin cross-sections and resulting flexibility. The helmet liner 69 can include a single bladder 28 having a plurality of chambers 100, a plurality of bladders 28, or a plurality of bladders 28 which include a plurality of chambers 100. When the helmet liner 69 extends near or below the position of the ear, it can sometimes be advantageous that an aperture or opening 49 be provided so that the wearer's 21 hearing will not be significantly impaired. The helmet liner 69 can be secured to the helmet 70.2 by snaps 77, VELCRO® hook and pile 78, adhesive, self-adhesive 79, straps, and other conventional means, whether in partial or complete combination.

Figure 19:
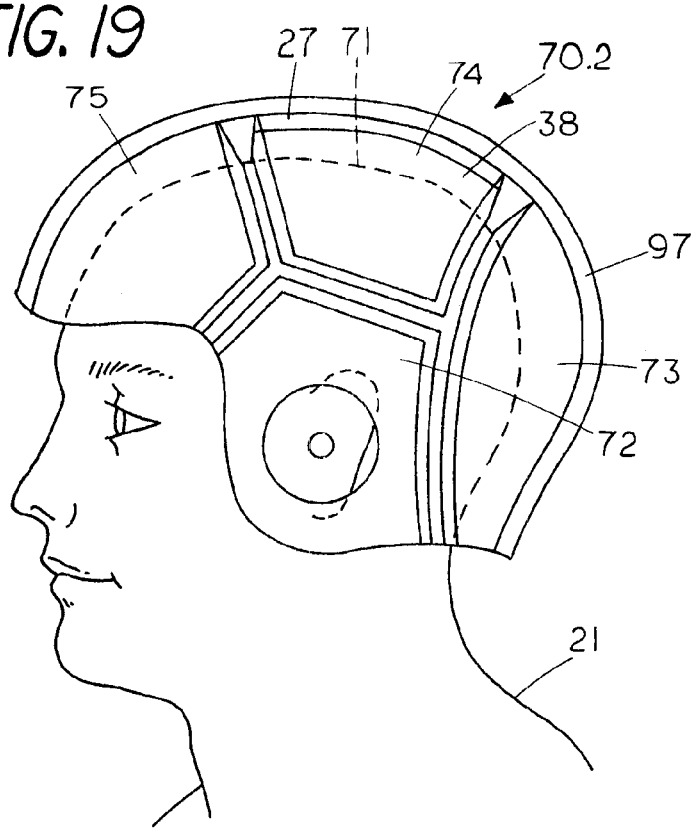
FIG. 19 is a perspective view of a helmet, with parts broken, away, positioned on a wearer.

FIG. 19 is a side perspective view of a helmet 70.2 Helmet 70.2 can be substantially made of a single material, or a plurality of materials. The outer shell 97 of helmet 70.2 can be made of a metal such as aluminum, steel, or titanium, carbon fiber or glass composite, thermoplastic such as polycarbonate or nylon, or a foam material such as a rigid foam. Various laminate helmet constructions are taught in U.S. Pat. No. 5,190,802, and the prior art patents recited therein. Alternately, the outer shell 97 of a helmet 70.2 can be made of a light cure material 27.

Figure 20:
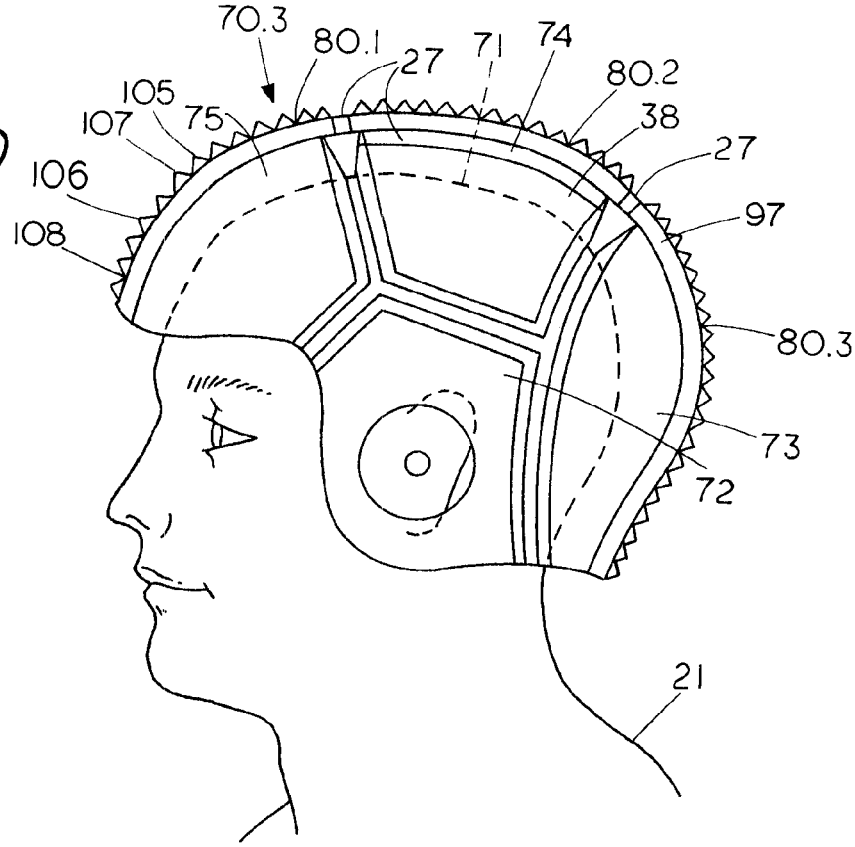
FIG. 20 is a perspective view of a helmet having a plurality of segments including light cure material therebetween, with parts broken away, positioned on a wearer.

Alternately, a helmet 70.3 can be made of a plurality of segments 80 having light cure material 27 positioned therebetween, as shown in FIG. 20. Further, the outer surface 108 of the outer shell 97 of a helmet 70.3 for use in soccer can include a tactified outer surface 106, a textured outer surface 107, and an outer surface 108 including raised grip elements 105, whether in partial or complete combination, for facilitating and possibly enhancing a wearer's ability to properly play a soccer ball when heading the ball, as desired. The outer shell 97 of the helmet 70.3 can include an elastomeric coating, such as polyurethane, and/or a thermoset or thermoplastic material such as natural or synthetic rubber. Suitable hybrid thermoplastic and rubber combinations can be used, including dynamically vulcanized alloys which can be injection molded such as those produced by Advanced Elastomer Systems, 338 Main Street, Akron, Ohio 44311, e.g., SANTOPRENE®, VYRAM®, GEOLAST®, and TREFSIN®. SANTOPRENE® is known to consist of a combination of butyl rubber and ethylene-propylene. Some of the elastomeric thermoplastic materials made by Advanced Elastomer Systems, such as SANTOPRENE®, can be bonded to relatively rigid thermoplastic materials, such as nylon, for making the outer shell 97 of a helmet 70.3. Another suitable material for use in making the outer shell 97 of a helmet 70.3 is polycarbonate. Soccer balls having advantageous geometry and tactified surfaces are taught in U.S. Pat. No. 5,040,795, and U.S. Pat. No. 5,181,717, assigned to Adidas, International. Soccer, shoes having a textured and tactified outer surface including raised grip elements are taught in U.S. Pat. No. 5,437,112, granted to Craig Johnson, a technology which is licensed and commercialized by Adidas, International under the PREDATOR® tradename. It can be readily understood that any or all of the alternate embodiments of a helmet taught herein can include a tactified outer surface, textured outer surface, or an outer surface including raised grip elements 105, in partial or complete combination.

Alternately, a helmet 70.4 can be made of a plurality of segments 80 which are substantially encapsulated by light cure material 27, as shown in FIG. 21. Further, it can be readily understood that a helmet liner can be formed integrally with the outer shell of a helmet. A wearer 21 can remove the helmet including light cure material from a container or package in which it is stored and shipped that does not permit the passage of substantial ultraviolet and visible light therethrough, and the wearer can simply attach the helmet in the presence of sunlight or a suitable man-made light source, and light cure material can be caused to cure while conforming to the anatomical features of the wearer, thereby retaining a custom fit and permanent memory.

Figure 22:
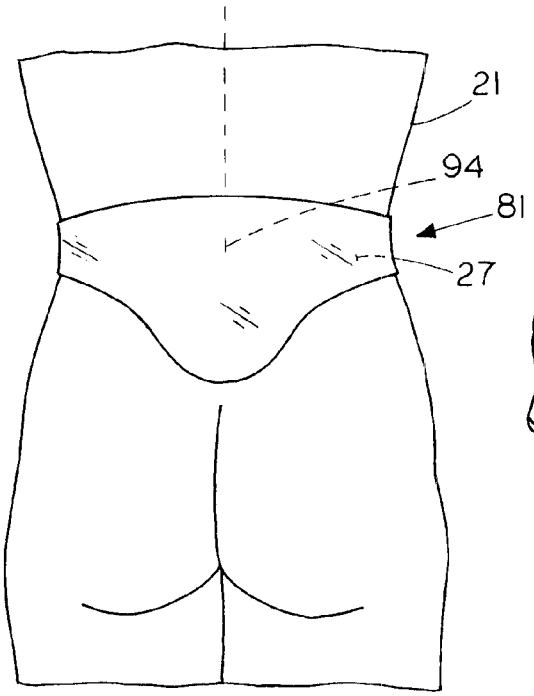
FIG. 22 is a perspective view of a back support including light cure material.

FIG. 22 is a perspective view of a back support 81 for supporting the lower back 94 of a wearer 21. A physical therapist can remove the back support 81 including light cure material 27 from a container or package in which it is stored and shipped that does not permit the passage of substantial light energy therethrough, and can place the patient's back and hips in a neutral or other desired position, then position the back support 81 in functional relation to the patient. In the presence of sunlight or a suitable man-made light source the light cure material 27 can be caused to cure while conforming to the anatomical features of the wearer 21, thereby retaining a custom permanent memory.

Figure 23:
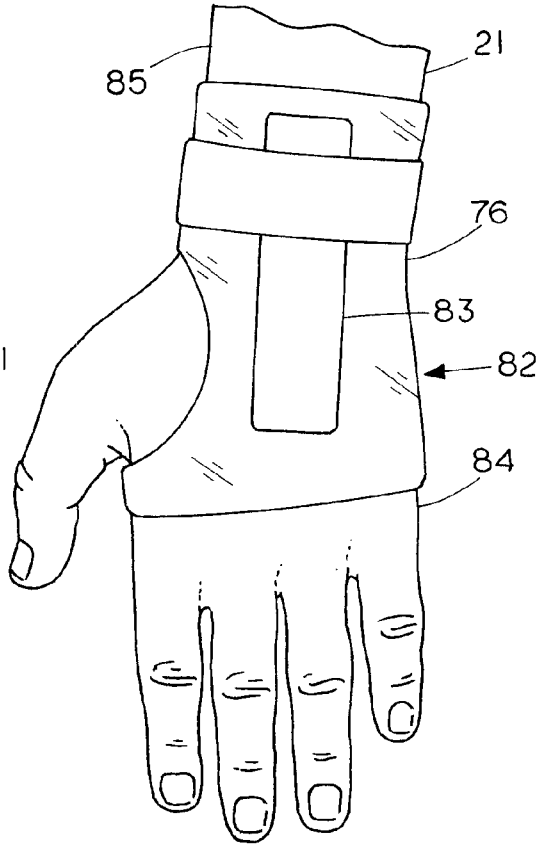
FIG. 23 is a perspective view of a wrist guard including light cure material positioned on a wearer.

FIG. 23 is a perspective view of a hand 84 and wrist 76 having a wrist guard 82, such as a brace, splint, or support affixed in position upon a wearer 21. The wrist support 82 can include a light cure material 27 contained in at least one bladder 28. The wrist support 82 can include a foam material 38, or other material. The foam material 38 is preferably a substantially closed cell or microcellular foam. The foam material 38 can be characterized by various contours and features such as peaks 39 and valleys 40, thus the proportion of foam material 38 and light cure material 27 can be engineered to vary in any given portion of the wrist support 82. The resulting wrist guard 82 can then be heterogeneous, that is, characterized by different physical and mechanical properties in different select locations, as desired. Alternately, the inner layer 30 of the hand and wrist support 82 can be made of a natural or synthetic fiber material, textile material, a thermoplastic material, a natural or synthetic rubber, and the like. It can be advantageous that the inner layer 30 of the wrist guard 82 be made of a stretchlastic or otherwise flexible material capable of elongation and distention so as to accommodate the anatomical features of the wearer. The substantially transparent film 26 can be affixed to the outside of the foam material 38 or other material used to make the inner layer 30 of the bladder 28 by adhesive, self-adhesive, light cure adhesive, radio frequency, microwave, or ultrasound welding, heat and pressure, and the like.

The wrist support 82 can also include a rigid member 83 for substantially preventing flexion of the hand 84 relative to the forearm 85 in one or more directions. This can be advantageous for use with individuals suffering from carpal tunnel syndrome, or can be used to create a hand and wrist guard 82 suitable for use by in-line skaters. Wrist guards suitable for the treatment of carpal tunnel syndrome include U.S. Pat. No. 5,769,804, U.S. Pat. No. 5,766,141, and U.S. Pat. No. 5,014,689, all of these patents hereby being incorporated by reference herein. Wrist guards suitable for in-line skaters include U.S. Pat. No. 5,813,050, U.S. Pat. No. 5,778,449, and U.S. Pat. No. 5,435,007 assigned to Rollerblade, Inc., all of these patents hereby being incorporated by reference herein.

An alternate embodiment and method of making any or all of the various preferred and alternate embodiments of an article of apparel, guard, pad, brace, or helmet recited herein can include the use of an impregnated textile material 55, that is, a textile material 41 which is coated or saturated with a light cure material 27. Impregnated textile materials 55 which can be cured using sunlight or a suitable man-made light source to make casts are known in the prior art, e.g., U.S. Pat. No. 4,512,340 granted to Carl Buck.

Figure 24:
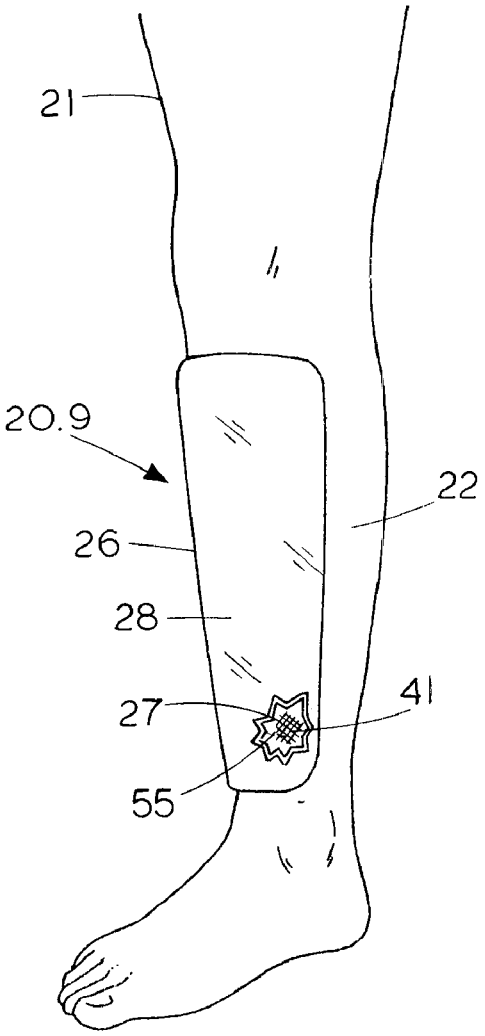
FIG. 24 is a perspective view of a shin guard including a bladder containing an impregnated textile material, with parts broken away positioned on a wearer.

However, as shown in FIG. 24, a perspective view of a shin guard 20.9, with parts broken away, it can be advantageous to enclose an impregnated textile 55 within a bladder 28, as this can both reduce oxygen inhibition with respect to the cure of some light cure materials 27, and prevent a user or wearer 21 from coming into direct physical contact with uncured light cure material 27. The impregnated textile material 55 can be made of a woven or non-woven material, a natural or synthetic material, glass, rayon, KEVLAR®, or carbon fiber, and the like. The light cure material 27 used to impregnate the textile material can form a rigid, or alternately, a non-rigid material when cured, as desired. An impregnated textile material 55 can be used with other cushioning materials such as padding, foam material, or a gas. In some cases, shin guard 20.9 can be removed from the bladder 28 after being cured by a suitable light source, and then be used by a wearer 20, as desired.

Figure 25:
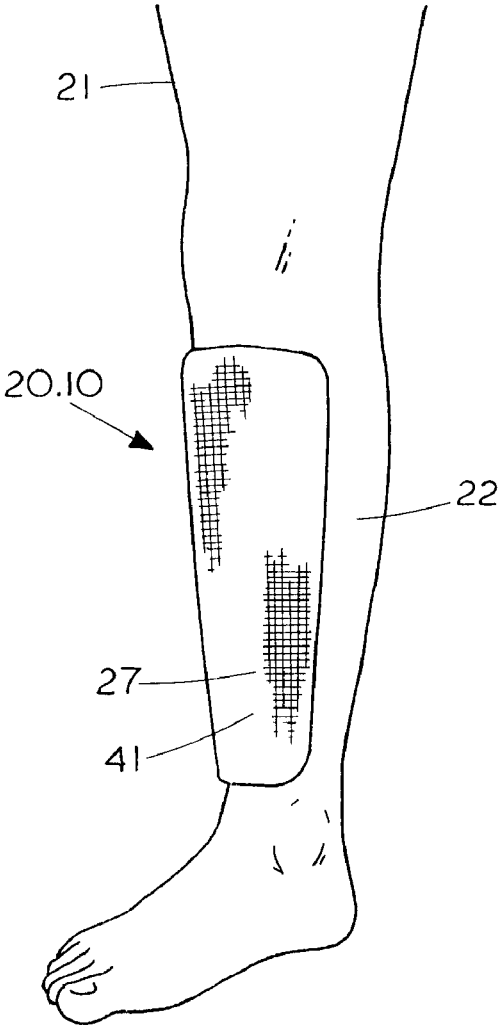
FIG. 25 is a perspective view of shin guard including an impregnated textile material positioned on a wearer.

FIG. 25, is a perspective view of a shin guard 20.10 substantially consisting of an impregnated textile material 55 which forms the exterior portion. An impregnated textile material 55 can be used to make a shin guard, pad, helmet or other article of apparel. The impregnated textile material 55 can be made of a woven or non-woven material, a natural or synthetic material, glass, rayon, KEVLAR®, or carbon fiber, and the like. Impregnated textile materials 55 are sometimes identified as "prepreg" materials. The surface of some uncured "prepreg" materials can be only slightly tacky to the touch, thus "prepreg" materials can be relatively easy to handle and manipulate with rubber gloves. Alternately, a thin layer of substantially transparent protective film 104 such as PVdC, or shrink wrap, can be used to cover the exterior surface of the impregnated textile material 55. After the article including the impregnated textile material 55 is donned by a wearer, and shaped to fit and cured, the thin layer of protective film 104 can be removed. The light cure material 27 used to impregnate the textile material can form a rigid, or alternately, a non-rigid material when cured, as desired. An impregnated textile material 55 can be used with other cushioning materials such as padding, foam material, or a bladder containing a captive gas.

Figure 26:
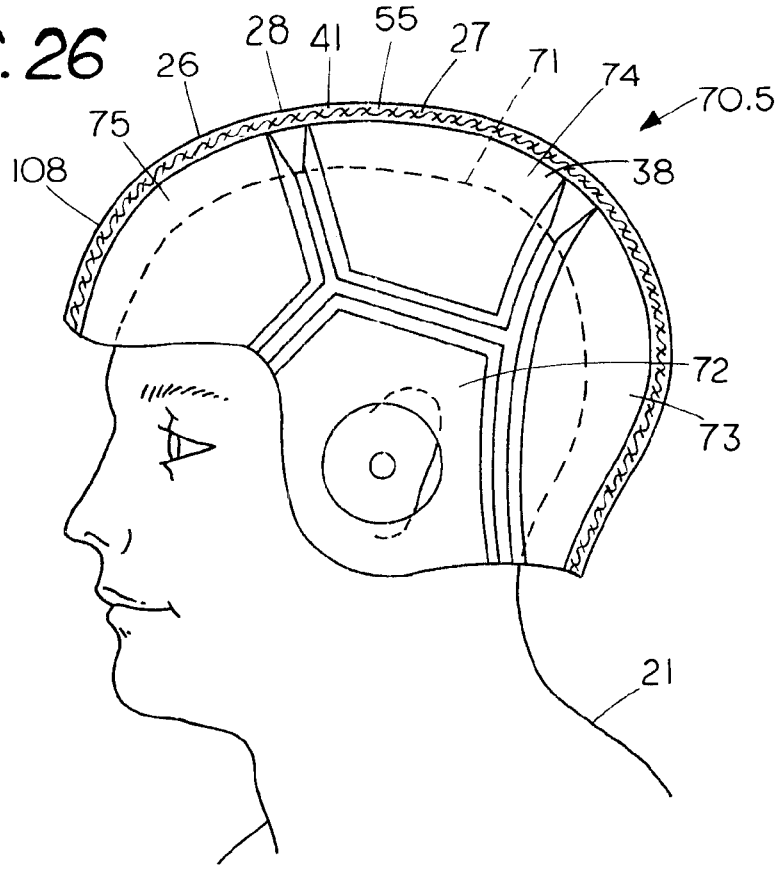
FIG. 26 is a perspective view of a helmet including a bladder containing an impregnated textile material, with parts broken away, positioned on a wearer.

FIG. 26 is a perspective view of an alternate helmet 70.5, with parts broken away, including an impregnated textile. 55 within a bladder 28. This configuration can both reduce oxygen inhibition with respect to the cure of some light cure materials 27, and prevent a user or wearer 21 from coming into direct physical contact with uncured light cure material 27. The impregnated textile material 55 can be made of a woven or non-woven material, a natural or synthetic material glass, rayon, KEVLAR®, or carbon fiber, and the like. The light cure material 27 used to impregnate the textile material can form a rigid, or alternately, a non-rigid material when cured, as desired. An impregnated textile material 55 can be used with other cushioning materials such as padding, foam material, or a gas. In some cases, the helmet 70.5 can be removed from the bladder 28 after being cured by a suitable light source, and then be used by a wearer 20, as desired.

Figure 27:
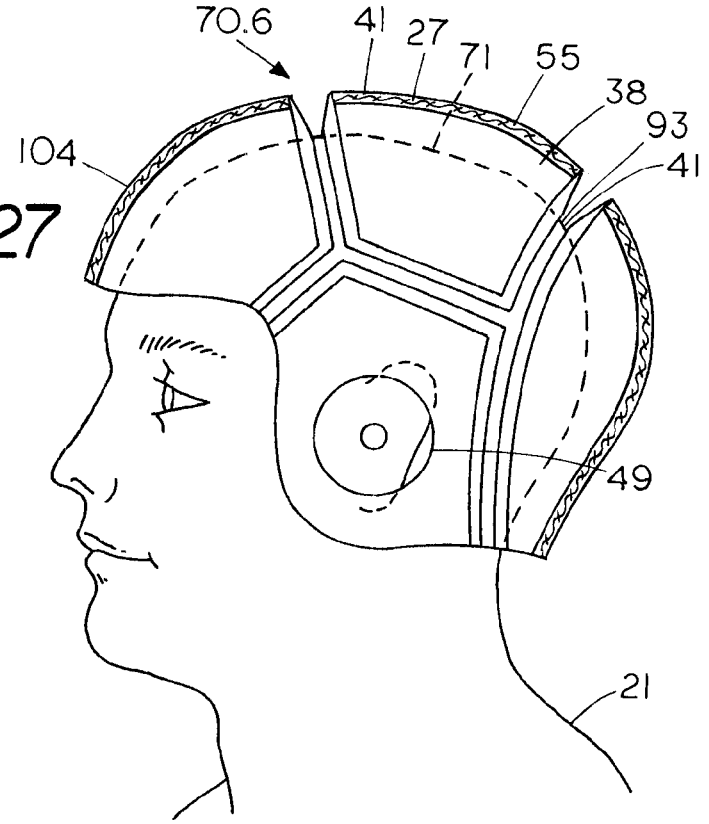
FIG. 27 is a perspective view of helmet including an impregnated textile material, positioned on a wearer.

FIG. 27, is a perspective view of a helmet 70.6 substantially consisting of an impregnated textile material 55 which forms the exterior portion. Again, an impregnated textile material 55 can be used to make a shin guard, pad, helmet or other article of apparel. The impregnated textile material 55 can be made of a woven or non-woven material, a natural or synthetic material, glass, rayon, KEVLAR®, or carbon fiber, and the like. Impregnated textile materials 55 are sometimes identified as "prepreg" materials. The surface of some uncured "prepreg" materials can be only slightly tacky to the touch, thus "prepreg" materials can be relatively easy to handle and manipulate with rubber gloves. Alternately, a thin layer of substantially transparent protective film 104 such as PVdC, or shrink wrap, can be used to cover the exterior surface of the impregnated textile material 55. After the article including the impregnated textile material 55 is donned by a wearer, and shaped to fit and cured, the thin layer of protective film 104 can be removed. The light cure material 27 used to impregnate the textile material can form a rigid, or alternately, a non-rigid material when cured, as desired. An impregnated textile material 55 can also be used in conjunction with other materials such as padding, foam material, or a gas.

It can be readily understood that the materials, structures, articles, and methods disclosed or recited herein, and their equivalents, can be used various combinations. Accordingly, while the above detailed description of,the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

I claim:

1. A guard for protecting a portion of a wearer's anatomy comprising a bladder containing a light cure material which can be caused to set and cure when exposed to light having a wavelength in the range between 280–780 nanometers.

2. The guard according to claim 1, further including a textile material.

3. The guard according to claim 2, wherein said textile material is impregnated with said light cure material and substantially contained within said bladder.

4. The guard according to claim 1, further including a foam material.

5. The guard according to claim 4, wherein said foam material is impregnated with said light cure material.

6. The guard according to claim 5, wherein said foam material has peaks and valleys.

7. The guard according to claim 1, further including a void comprising a gas.

8. The guard according to claim 1, further comprising an inner bladder and an outer bladder configured in an overlapping relationship.

9. The guard according to claim 1, further comprising two bladders configured in a side-by-side relationship.

10. The guard according to claim 1, wherein said guard comprises a shin-guard.

11. The shin-guard according to claim 10, further including a side guard, and a posterior guard.

12. The guard according to claim 1, wherein said guard comprises a wrist guard.

13. A method of making a guard including a light cure material which can be caused to set and cure when exposed to light having a wavelength in the range between 280–780 nanometers comprising:

a) Opening a container which is substantially impenetrable to said light and removing said shin-guard;

b) Placing said shin-guard in position upon a wearer; and, c) Exposing said shin-guard to said light causing said light cure material to cure.

14. A pad for protecting a portion of a wearer's anatomy comprising a bladder containing a light cure material which can be caused to set and cure when exposed to light having a wavelength in the range between 280–780 nanometers.

15. The pad according to claim 14, further including a textile material.

16. The pad according to claim 15, wherein said textile material is impregnated with said light cure material and substantially contained within said bladder.

17. The pad according to claim 14, further including a foam material.

18. The pad according to claim 17, wherein said foam material is impregnated with said light cure material.

19. The pad according to claim 18, wherein said foam material has peaks and valleys.

20. The pad according to claim 14, further including a void comprising a gas.

21. The pad according to claim 14, further comprising an inner bladder and an outer bladder configured in an overlapping relationship.

22. The pad according to claim 14, further comprising two bladders configured in a side-by-side relationship.

23. The pad according to claim 14, wherein said pad comprises a knee-pad.

24. The pad according to claim 14, wherein said pad comprises an elbow pad.

25. The pad according to claim 14, wherein said pad comprises a pad taken from the select group of pads for protecting a portion of a wearer's anatomy consisting of shin-pads, knee pads, thigh pads, hip pads, rib pads, shoulder pads, elbow pads, forearm pads, biceps pads, neck pads, glove pads, chin strap pads, and back support pads.

26. A method of making a pad including a light cure material which can be caused to set and cure when exposed to light having a wavelength in the range between 280–780 nanometers comprising:

a) Opening a container which is substantially impenetrable to said light and removing said pad;

b) Placing said pad in position upon a wearer; and, c) Exposing said pad to said light causing said light cure material to cure.

27. A shin-guard comprising a bladder containing a textile material impregnated with a light cure material which can be caused to set and cure when exposed to light having a wavelength in the range-between 280–780 nanometers, said shin-guard further comprising a pocket for removably inserting said bladder.

28. A shin-guard comprising a bladder containing a first textile material impregnated with a light cure material which can be caused to set and cure when exposed to light having a wavelength in the range between 280–780 nanometers, said bladder being affixed in functional relation to a second textile material including mechanical means for affixing said shin-guard upon a wearer.

* * * * *